US009854835B2

(12) United States Patent
Bardelli

(10) Patent No.: US 9,854,835 B2
(45) **Date of Patent: *Jan. 2, 2018**

(54) APPARATUS FOR CUTTING AND STORING A CIGARETTE

(71) Applicant: Anthony J. Bardelli, Derby, CT (US)

(72) Inventor: Anthony J. Bardelli, Derby, CT (US)

( * ) Notice: Subject to any disclaimer, the term of this patent is extended or adjusted under 35 U.S.C. 154(b) by 832 days.

This patent is subject to a terminal disclaimer.

(21) Appl. No.: 14/246,681

(22) Filed: Apr. 7, 2014

(65) Prior Publication Data

US 2014/0202473 A1 Jul. 24, 2014

Related U.S. Application Data

(63) Continuation of application No. 13/418,347, filed on Mar. 13, 2012, now Pat. No. 8,695,608, which is a continuation-in-part of application No. PCT/US2011/025868, filed on Feb. 23, 2011.

(51) Int. Cl.

| | |
|---|---|
| ***A24F 13/24*** | (2006.01) |
| ***A24F 23/00*** | (2006.01) |
| ***A24F 15/18*** | (2006.01) |
| ***A24F 13/20*** | (2006.01) |

(52) U.S. Cl.

CPC ..... *A24F 23/00* (2013.01); *A24F 13/20* (2013.01); *A24F 13/24* (2013.01); *A24F 15/18* (2013.01)

(58) Field of Classification Search

CPC ..... A24F 23/00; A24F 15/18; A24F 13/20; A24F 13/26; A24F 15/12

See application file for complete search history.

(56) References Cited

U.S. PATENT DOCUMENTS

| | | | | |
|---|---|---|---|---|
| 4,160,318 A * | 7/1979 | Morel | A24F 13/24 131/248 |
| 5,913,676 A * | 6/1999 | Kim | A24F 13/26 131/249 |
| 5,947,280 A * | 9/1999 | Jimenez | A24F 13/20 131/248 |
| 6,151,781 A * | 11/2000 | Dehler | A24F 13/26 131/248 |
| 2007/0000502 A1* | 1/2007 | Chong | A24F 13/24 131/249 |

FOREIGN PATENT DOCUMENTS

| | | |
|---|---|---|
| KR | 1020070034363 | 3/2007 |
| WO | 2011/106381 | 9/2011 |

* cited by examiner

*Primary Examiner* — Eric Yaary

(57) ABSTRACT

An apparatus has a housing that has a first section and a second section. The first section has a first compartment for storing a cigarette and a second compartment for containing a cutting device having a blade. The first compartment is sealed from the second compartment. A slide button on the housing allows the user to move the cutting device within the second compartment. The second section has an opening and a hollow interior that are sized to allow a user to insert a portion of a cigarette through the opening and into the hollow interior. A user inserts the used portion of a cigarette into the opening and hollow interior and then uses the slide button to move the blade into the hollow interior to cut off the used portion of the cigarette. The user then places the remaining portion of the cigarette in the first compartment.

14 Claims, 29 Drawing Sheets

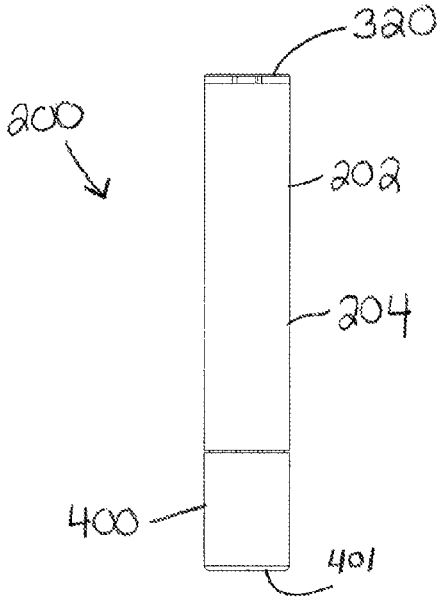
Fig. 31
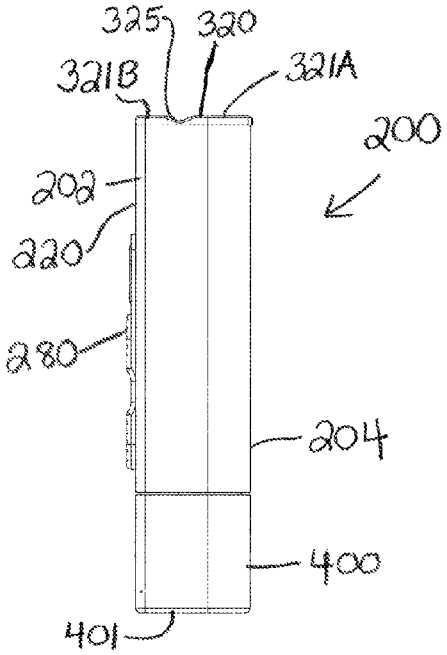
Fig. 32
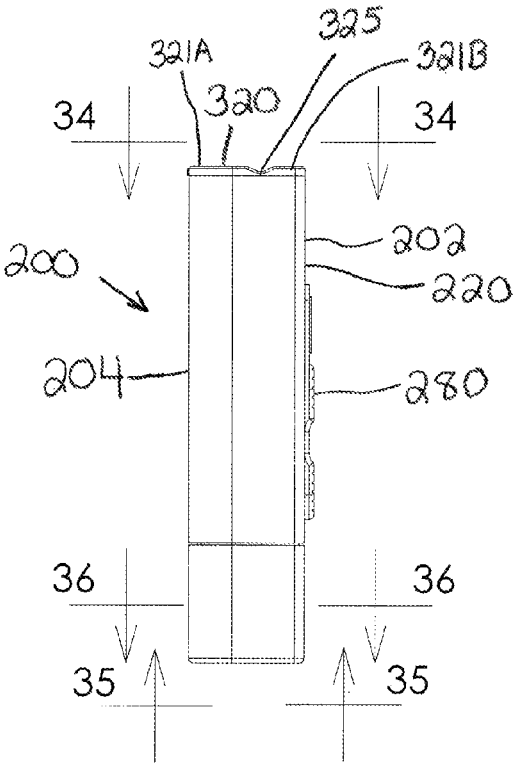
Fig. 33
Fig. 34
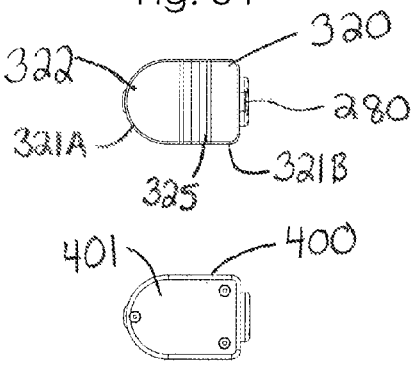
Fig. 35

APPARATUS FOR CUTTING AND STORING A CIGARETTE

CROSS-REFERENCE TO RELATED APPLICATIONS

This application is a continuation of U.S. application Ser. No. 13/418,347, filed Mar. 13, 2012, which is a continuation-in-part of International Application No. PCT/US2011/025868, filed Feb. 23, 2011. The entire disclosure of U.S. application Ser. No. 13/418,347 is hereby incorporated by reference.

TECHNICAL FIELD

The present invention relates to an apparatus for cutting and storing cigarettes.

BACKGROUND ART

The present invention concerns a portable cigarette cutter and container. A number of cigarette or cigar containers are known in the art. For example, Nielander U.S. Pat. No. 5,345,952 is directed to a portable cigarette cutter, extinguisher and conveyance apparatus. A cigarette is inserted into an aperture located co-axially in a comparatively large, round cylindrical container having a lower reservoir 14 and upper enclosure and receiver assembly 16. The Nielander device is significantly larger than the size of a cigarette. Next, the user pushes a member 18 which moves a blade traversely through the cigarette to slice off part of it. The sliced-off part of the cigarette is moved into the reservoir and deprived of air, causing it to extinguish. Nielander discloses that the device described therein has a convenient size to be readily portable and that it is a conveyance apparatus. However, Nielander does not contemplate transporting the remaining, unused portion of the cigarette in the Nielander apparatus. Nielander discloses, in column 8, lines 21-24, that the cigarette smoker retains the remaining, unused portion of the cigarette 12 (i.e. without the severed portion 158) and stores that remaining, unused portion of the cigarette in a cigarette pack for further usage. Nielander does not disclose a combination cigarette-cutter and transport case for the unused portion of the severed cigarette. The Nielander device is significantly larger than a single cigarette and is therefore not suitable for carrying in a shirt or pants pocket.

Numerous other patents are directed to cigarette extinguishers, cigar extinguishers, cigarette storage devices and cigar storage devices. Sieggen et al. U.S. Pat. No. 6,431,177 discloses a device that is roughly shaped like a fountain pen for extinguishing and storing a cigarette. Taylor U.S. Pat. No. 5,345,953 describes a cylindrical-shaped cigarette snuffer. Taylor discloses that the snuffer may be placed in a cigarette pack. However, Taylor does not disclose a cutting device. Musick U.S. Pat. No. 3,978,981 discloses a cylindrical device for a lighted cigar holder that is also applicable to cigarettes. This permits the user to carry a lighted cigar or cigarette on his or her person. Musetti U.S. Pat. No. 4,809,715 discloses a pocket ashtray in which a cigarette or cigar is extinguished. The Musetti device is a cylindrically-shaped, pen-sized device.

Related devices are disclosed in Irvin U.S. Pat. No. 2,371,445, Field U.S. Pat. No. 2,715,961, Johnson U.S. Pat. No. 2,120,027, Chiang U.S. Pat. No. 5,002,073, and Mauldin U.S. Pat. No. 7,409,955. Chiang U.S. Pat. No. 5,002,073 discloses the combination of a writing tool with a cigarette extinguisher. Mauldin U.S. Pat. No. 7,409,955 discloses a device that allows clipping or severing the used part of a cigarette and the insertion of the remaining unused portion into a compact carrying case for storage and subsequent use. However, this patent does not teach or disclose a device with a vertical and sealable pop-up lid or the ability to place the device in a box of cigarettes.

Other devices used with cigarettes and cigars are described in U.S. Pat. Nos. 4,660,575, 5,345,952, 5,752,528, 5,791,051, 5,888,061, 5,913,676, 6,151,781 and 6,527,545, and in U.S. Patent Application Publication Nos. 2009/0165807 and 2007/0000502.

DISCLOSURE OF THE INVENTION

Many cigarette smokers encounter certain times when they cannot or do not want to finish an entire cigarette. Typically, a smoker chooses to throw away the unused, extinguished cigarette because of the foul odor from the unfinished cigarette and because such unfinished cigarette will taint the fresh cigarettes still in the cigarette pack. The present invention solves these problems. The present invention is directed to an apparatus for cutting away a used portion of a cigarette and storing the remaining, unused portion of the cigarette. Thus, the present invention is configured to enable a smoker to cleanly cut off the used (or burnt portion) of a cigarette that has not been completely finished. Specifically, the smoker extinguishes the lit end of the cigarette and inserts that end of the cigarette into the bored-out hole in the apparatus of the present invention. The smoker then operates a cutting mechanism, which is part of the apparatus of the present invention, to cleanly cut off the used or burnt end of the cigarette. The apparatus has a sealed storage compartment with a vertical pop-up lid that stores the cut cigarette without tainting the rest of the pack. In accordance with the invention, the apparatus is designed, shaped and sized so that it can fit within a pack of cigarettes. The present invention provides a user with the ability to save an unfinished cigarette for use at a later time and save money.

Therefore, one object of this invention is to provide a method for storing a partially smoked cigarette within or outside of a box of cigarettes using the apparatus of the present invention which contains a cutting mechanism and a sealed storage compartment with a vertical pop-up lid. A smoker can simply cut an unfinished cigarette or smoking material with the cutting means and place it in the sealed storage compartment for later use. A smoker who uses the apparatus and method of the present invention can save up to three quarters of an unfinished cigarette to smoke later. Due to ever-increasing costs and taxes on cigarettes, a smoker's costs will be reduced using the present invention. Smokers may also cut down on the amount of cigarettes smoked.

A further object of the present invention is to provide a method of cutting and storing a cigarette comprising the steps of inserting an extinguished cigarette into a bored-out hole, applying pressure to the bottom portion of the cutting mechanism to cleanly cut off the burnt end of the cigarette, forcing the blade through the center of the bored-out hole, and placing the cigarette into a sealed storage compartment with a pop-up lid. The sealed storage compartment may then be inserted into a standard size or larger box or pack of cigarettes or cigars.

Thus, in one aspect, the present invention is directed to an apparatus for storing a cigarette comprising a storage container having an interior compartment for storing a cigarette. The storage container has a first end defining an opening in communication with the interior compartment and a second end that is closed and which is opposite the first end. The apparatus has a lid pivotally attached to the storage container at the open end. The lid is pivotal between a first position that covers the opening in the first end and a second position that exposes the opening in the first end. The lid has an exterior side and an opposite interior side. The opposite side has a raised portion that is sized to frictionally fit into the opening in the first end of the storage container when the lid is completely closed. The lid includes a tab to enable a user to pop open the lid. In one embodiment, the storage container is substantially cylindrical in shape and the lid is substantially circular in shape.

In a related aspect, the present invention is directed to an apparatus for cutting away a used portion of a cigarette and storing the remaining portion of the cigarette. The apparatus comprises a storage container having an interior compartment for storing a cigarette. The storage container has a first end defining an opening in communication with the interior compartment and a second end that is closed and which is opposite the first end. The apparatus further comprises a lid pivotally attached to the storage container at the first end. The lid is pivotal between a first position that covers the opening in the first end and a second position that exposes the opening in the first end. The lid has an exterior side and an opposite interior side. The opposite side has a raised portion that is sized to frictionally fit into the opening in the first end of the storage container when the lid is completely closed. The lid includes a tab to enable a user to pop open the lid. In one embodiment, the storage container is substantially cylindrical in shape and the lid is substantially circular in shape. The apparatus further comprises a cutting device attached to the second end of the storage container. The cutting device comprises a cutting blade and a region for receiving a portion of cigarette that is to be cut with the cutting blade. In a preferred embodiment, the cutting device is removably attached to the second end. In one embodiment, the second end of the storage container comprises a portion that defines threads and the cutting device has a portion thereof that defines complementary threads. In such an embodiment, the cutting device is threadedly attached to the second end of storage container.

In yet another aspect, the present invention is directed to an apparatus for cutting away a used portion of a cigarette and storing the remaining portion of the cigarette. The apparatus comprises a storage container having an interior compartment for storing a cigarette. The storage container has a first end defining an opening in communication with the interior compartment and a second that is closed and which is opposite the first end. The apparatus further comprises a lid pivotally attached to the storage container at the first end. The lid is pivotal between a first position that covers the opening in the first end and a second position that exposes the opening in the first end. The lid has an exterior side and an opposite interior side. The opposite, interior side has a raised portion that is sized to frictionally fit into the opening in the first end of the storage container when the lid is completely closed. The lid further includes a tab to enable a user to pop open the lid. The apparatus further comprises means, removably attached to the second end of the storage container, for cutting away a portion of a cigarette.

In a further aspect, the present invention is directed to an apparatus for cutting away a used portion of the cigarette and storing the remaining portion of the cigarette. The apparatus comprises a housing having a first interior compartment for storing a cigarette and a second interior compartment that is separate and sealed off from the first interior compartment. The housing has a first end that defines openings to the first and second interior compartments and a second end that defines an opening only to the second interior compartment. The housing has an exterior wall that is a part of the second interior compartment. The exterior wall has first and second openings that are located between the first and second ends of the housing. The second opening in the exterior wall is adjacent to the second end of the housing and is sized to receive a portion of a cigarette. The apparatus further comprises a cutting device movably positioned within the second interior compartment. The cutting device can move in a first direction toward the first end of the housing or in an opposite second direction toward the second end of the housing. The cutting device has a portion accessible through the first opening in the external wall of the housing so as to enable a user to move the cutting device either in the first direction or second direction. The cutting device has a cutting blade. When a user inserts a portion of a cigarette into the second opening in the exterior wall of the housing and moves the cutting device in the second direction, the cutting blade cuts off a portion of the cigarette. The first and second interior compartments are positioned side-by-side or in juxtaposition. The apparatus further comprises a first cap removably attached to the first end of the housing to close off the openings to the first and second interior compartments, and a second cap removably attached to the second end of the housing to close off the opening to the second interior compartment. The apparatus further comprises a cover movably attached to the housing. The cover is movable between a closed position which covers the first and second openings in the exterior wall of the housing and an opened position which exposes the first and second openings in the exterior wall of the housing. The cover comprises side portions that frictionally contact the housing when the cover is in the closed position.

In another embodiment, the present invention is directed to an apparatus for cutting away a used portion of a cigarette and storing the remaining portion of the cigarette. The apparatus comprises a housing having a first housing section having a first interior compartment for storing a cigarette and a second interior compartment that is separate from the first interior compartment. The first housing section has a first end that has an opening to allow a cigarette to be inserted into or removed from the first interior compartment. The first housing section further comprises a second end that is opposite the first end. The second end closes off the first compartment and has a passageway that leads to the second interior compartment. The first housing section has an exterior wall that is a part of the second interior compartment. The exterior wall has an elongated opening therein which is located between the first and second ends of the first housing section and which is in communication with the second interior compartment. The elongated opening extends longitudinally along the exterior wall. The housing further comprises a second housing section joined to the second end of the first housing section. The second housing section has a front side, an opposite rear side, a hollow interior and an opening in the front side that provides access to the hollow interior. The opening in the front side and the hollow interior are sized for receiving a portion of a cigarette. The passageway in the second end of the first housing section is in communication with the hollow interior. A cutting device is movably positioned within the second interior compartment. The cutting device can move in a first direction toward the first end of the first housing section or in an opposite, second direction toward the second end of the first housing section. The cutting device comprises a cutting blade that passes through the passageway of the second end of the first housing section and enters the hollow interior of the second housing section when the cutting device is moved in the opposite second direction. The cutting device has a portion thereof that is accessible through the elongated opening in the exterior wall of the first housing section. A slide button is positioned on the first housing section and has a portion that extends through the elongated opening and is connected to the cutting device. The slide button allows a user to move the cutting device in the first and second directions. When a user desires to cut off a used portion of a cigarette, the user inserts the used portion of the cigarette into the opening of the second housing section so that the used portion of the cigarette enters the hollow interior. The user then uses the slide button to move the cutting device in the second direction so that the cutting blade passes through the passageway and into the hollow interior to cut off the used portion of the cigarette. A cap is removably attached to the first end of the first housing section to close off access to the first and second interior compartments. The cap has a top side and a bottom side, wherein the bottom side comprises a structure that has a projection. The first housing section has an opening formed therein which is in proximity to the first end of the first housing section and is sized to receive the projection of the cap. A cover is movably attached to the second housing section and movable between a first position which completely conceals the second housing section and a second position that exposes the second housing section. The cover has a hollow interior that is sized for receiving the entire second housing section. In a preferred embodiment, the cover is slidably attached to the second housing section. The rear side of the second housing section includes an opening that is substantially coaxially aligned with the opening in the front side of the second housing section. The hollow interior is also accessible through the second opening in the rear side. Thus, a cigarette can be inserted through the opening in the front side until a desired portion of the cigarette extends from the opening in the rear side of the second housing section.

Other aspects of the present invention are described in detail in the ensuing description.

BRIEF DESCRIPTION OF THE DRAWINGS

The features of the invention are believed to be novel. The figures are for illustration purposes only and are not drawn to scale. The invention itself, however, both as to organization and method of operation, may best be understood by reference to the detailed description which follows taken in conjunction with the accompanying drawings in which:

FIG. 31 is rear view, in elevation, of the apparatus of FIG. 19 completely assembled;

FIG. 32 is a side view, in elevation, of the apparatus of FIG. 19 completely assembled, the view showing the left side of the apparatus;

FIG. 33 is a side view, in elevation, of the apparatus of FIG. 19 completely assembled, the view showing the right side of the apparatus;

FIG. 34 is a top view taken along line 34-34 of FIG. 33;

FIG. 35 is a bottom view taken along line 35-35 of FIG. 33;

BEST MODE FOR CARRYING OUT THE INVENTION

The present invention is related to the invention disclosed in International Application No. PCT/US2011/025868. The disclosure of International Application No. PCT/US2011/025868 is hereby incorporated by reference.

As used herein, the term "smoking material" shall mean an object or device such as a cigarette or cigar which is smoked by a smoker and includes, without being limited thereto, various sizes of plain and filtered cigarettes, non-filtered cigarettes, cigars, cheroots and the like. As used herein, the phrase "fire-resistant material" includes fire-retardant or intumescent materials.

Figure 1:
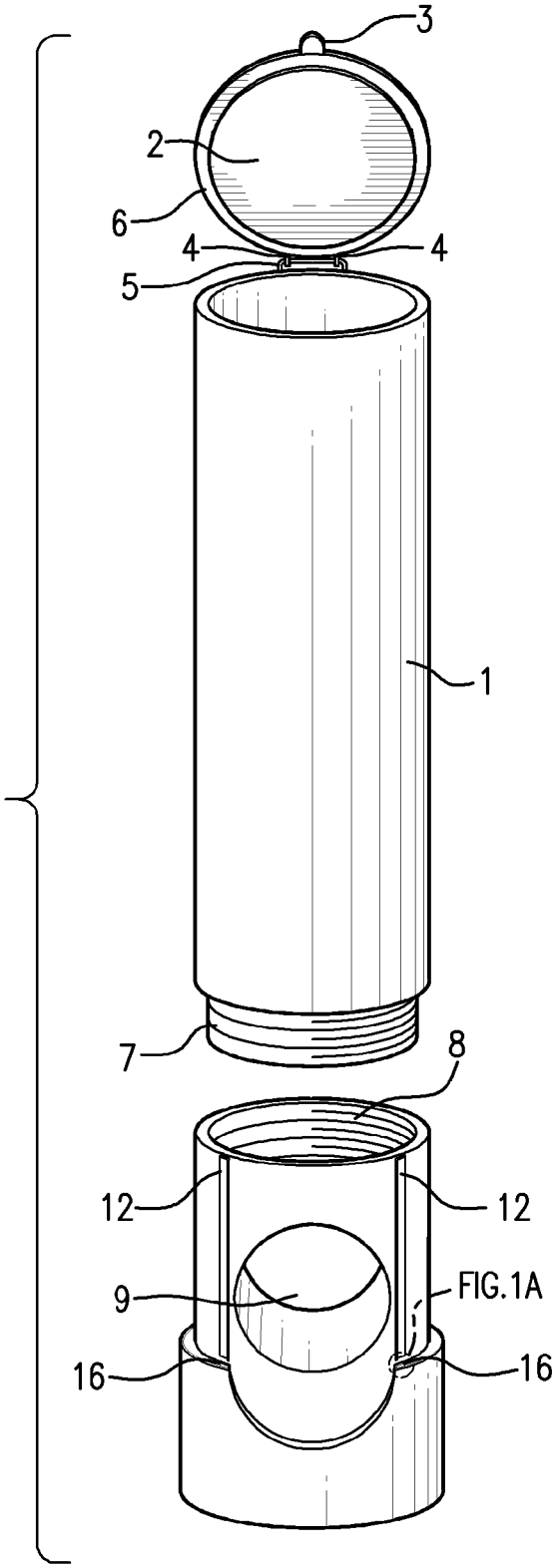
FIG. 1 is an exploded, front view of an apparatus for cutting and storing a cigarette in accordance with one embodiment of the present invention, the view showing a sealed storage compartment and a two-section cutting mechanism.
Figure 1A:
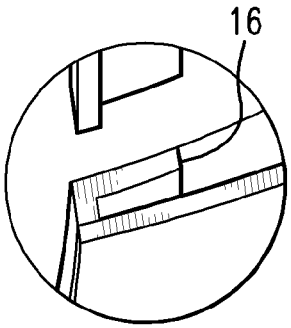
FIG. 1A is an enlarged view of a portion of the view in FIG. 1.
Figure 2:
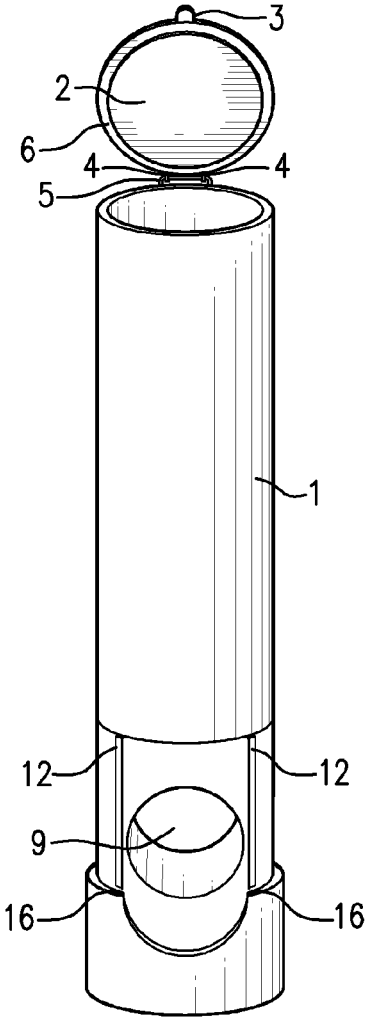
FIG. 2 is a front view, in elevation, of the apparatus of FIG. 1 completely assembled.
Figure 4:
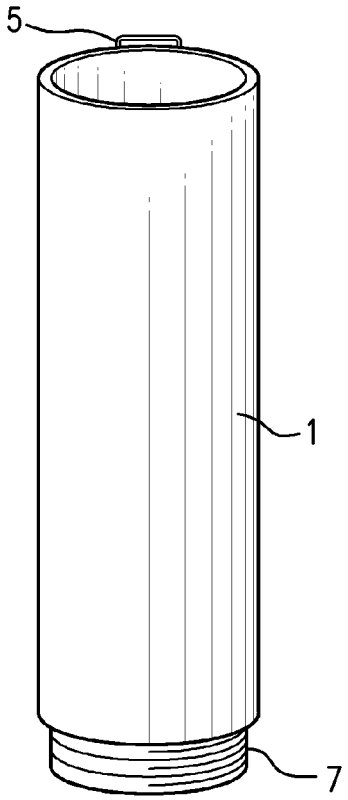
FIG. 4 is front view, in perspective, of the sealed storage compartment shown in FIGS. 1 and 2.
Figure 3:
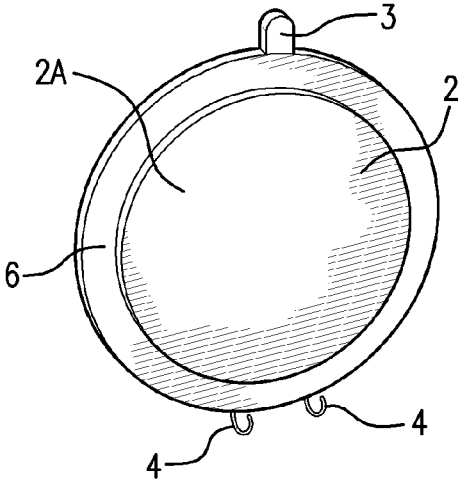
FIG. 3 is a perspective view of a pop-up lid shown in FIGS. 1 and 2.
Figure 5:
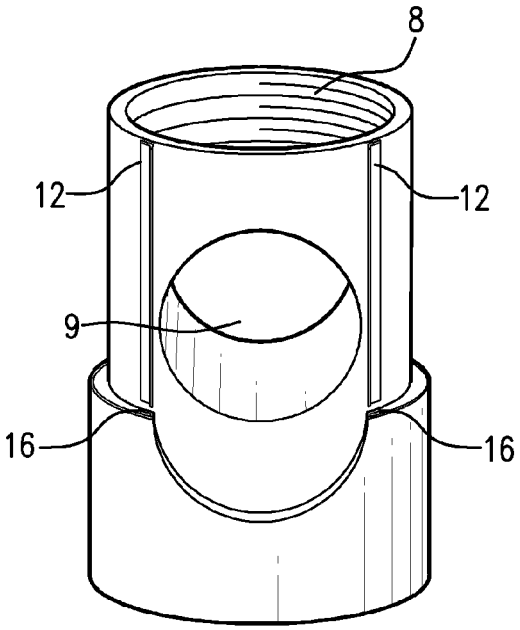
FIG. 5 is a front view, in perspective, of the cutting mechanism shown in FIGS. 1 and 2.

Referring to FIGS. 1, 1A, 2, 3, 4 and 5, the apparatus of the present invention generally comprises sealed storage compartment 1. The overall size of the sealed storage compartment 1 will vary depending on the type of cigarette 10 or smoking material it is intended to hold (see FIG. 8). A vertical pop-up lid 2 with a tab 3 for easy opening and closing is attached to the top of the sealed storage compartment 1 by two lid hooks 4 and a snap-on hinge 5. The two lid hooks 4 are injection molded on the vertical pop-up lid 2. The two lid hooks 4 connect to the snap-on hinge 5 which is injection molded on the top of the sealed storage compartment 1. An indent 6 is injection molded within the inner diameter of the vertical pop-up lid 2 to provide a seal when it is closed. Specifically, the formation of indent 6 creates raised portion 2A (see FIG. 3). Raised portion 2A is sized to frictionally fit within the opening of storage compartment 1 so as to create a seal. This seal protects the pack of unused cigarettes 17 from being tainted (see FIG. 9). Male threads 7 extend off the bottom of the sealed storage compartment (1). As shown in FIG. 5, the completely assembled cutting mechanism has female threads 8 inside the top portion which engage male threads 7.

Figure 6:
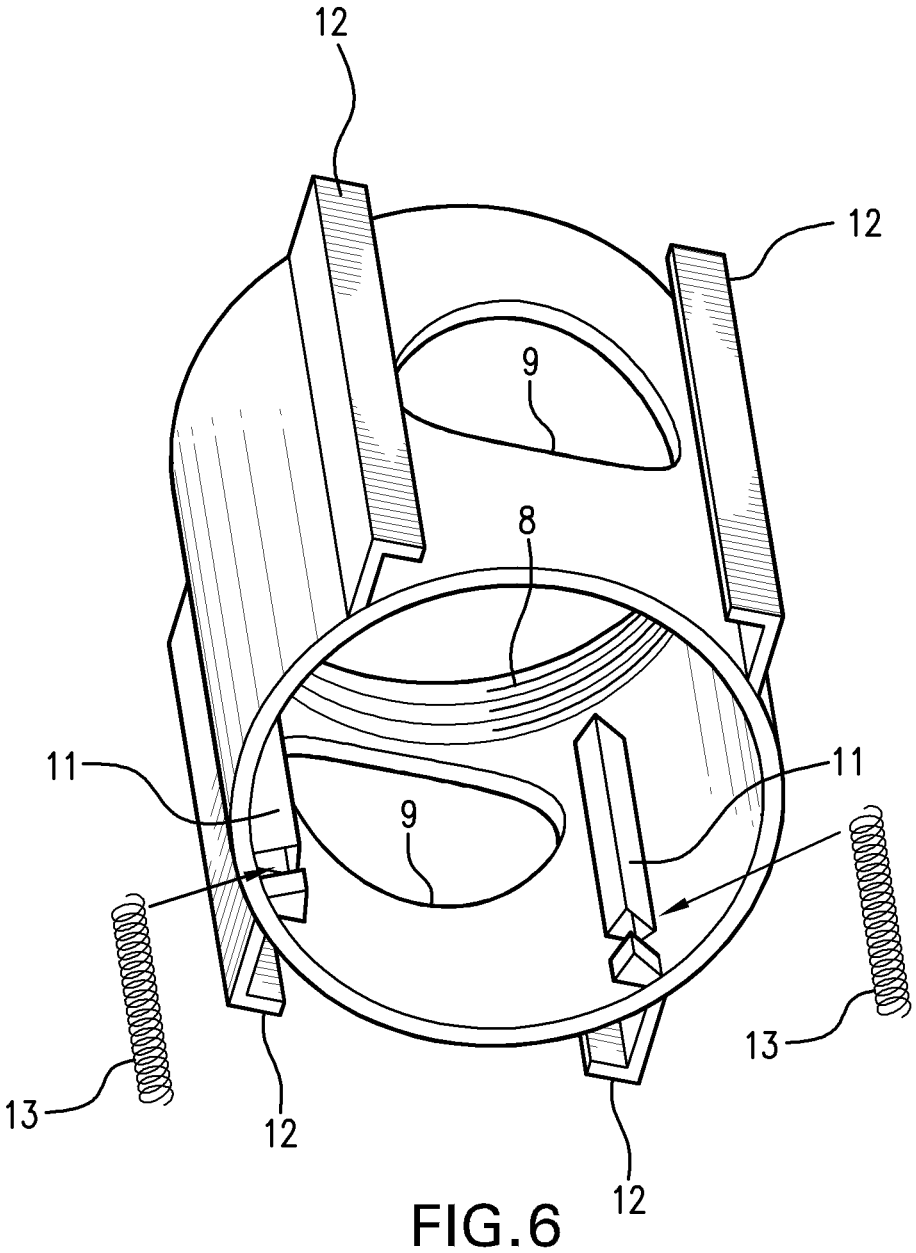
FIG. 6 is perspective view of the interior of the cutting mechanism, the view showing external tracks, internal tracks, springs, female threads and a bored-out hole.
Figure 7:
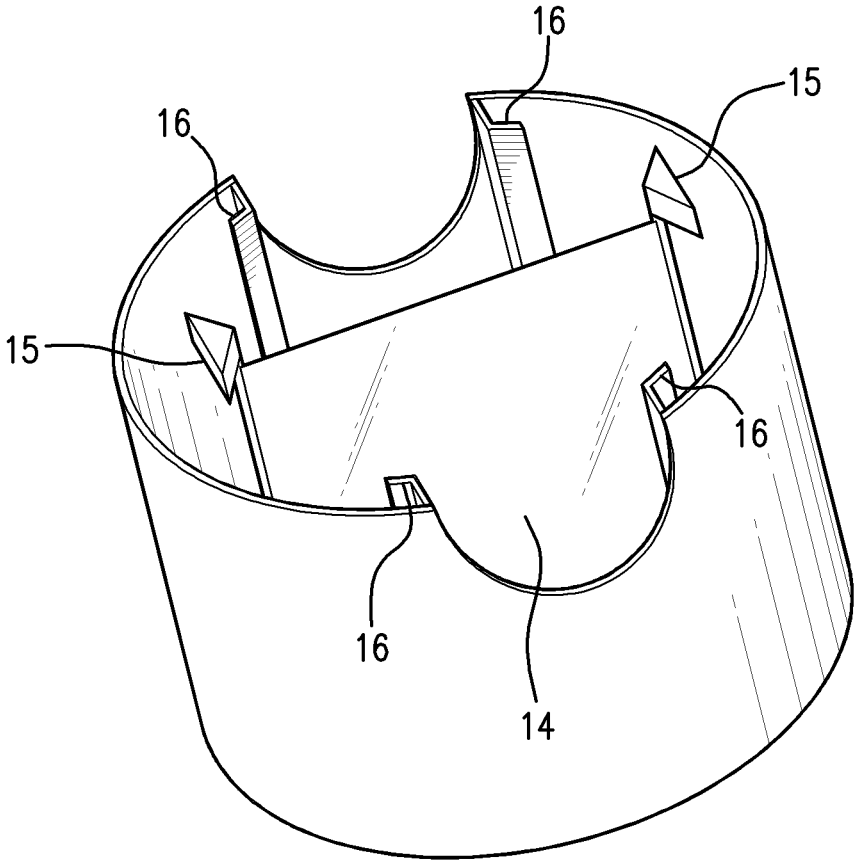
FIG. 7 is a perspective view of a bottom section of the cutting mechanism, the view showing blade guide hooks, a steel cutting blade, and supporting hooks.
Figure 8:
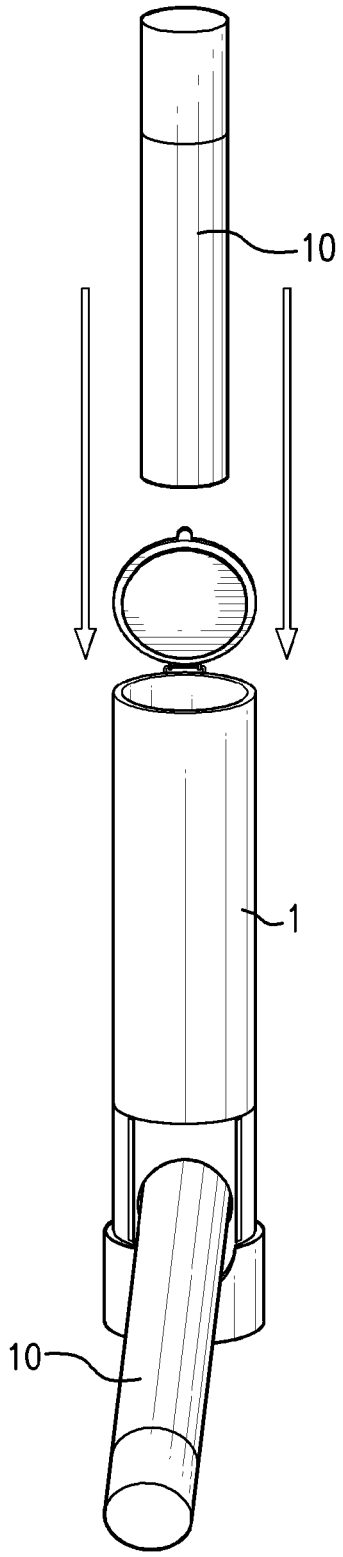
FIG. 8 is an exploded view, in perspective, showing the apparatus of FIG. 1 and a cigarette, the view showing how a cigarette can be inserted into the sealed storage compartment of the apparatus and how the burnt portion of a cigarette can be cleanly cut off.
Figure 9:
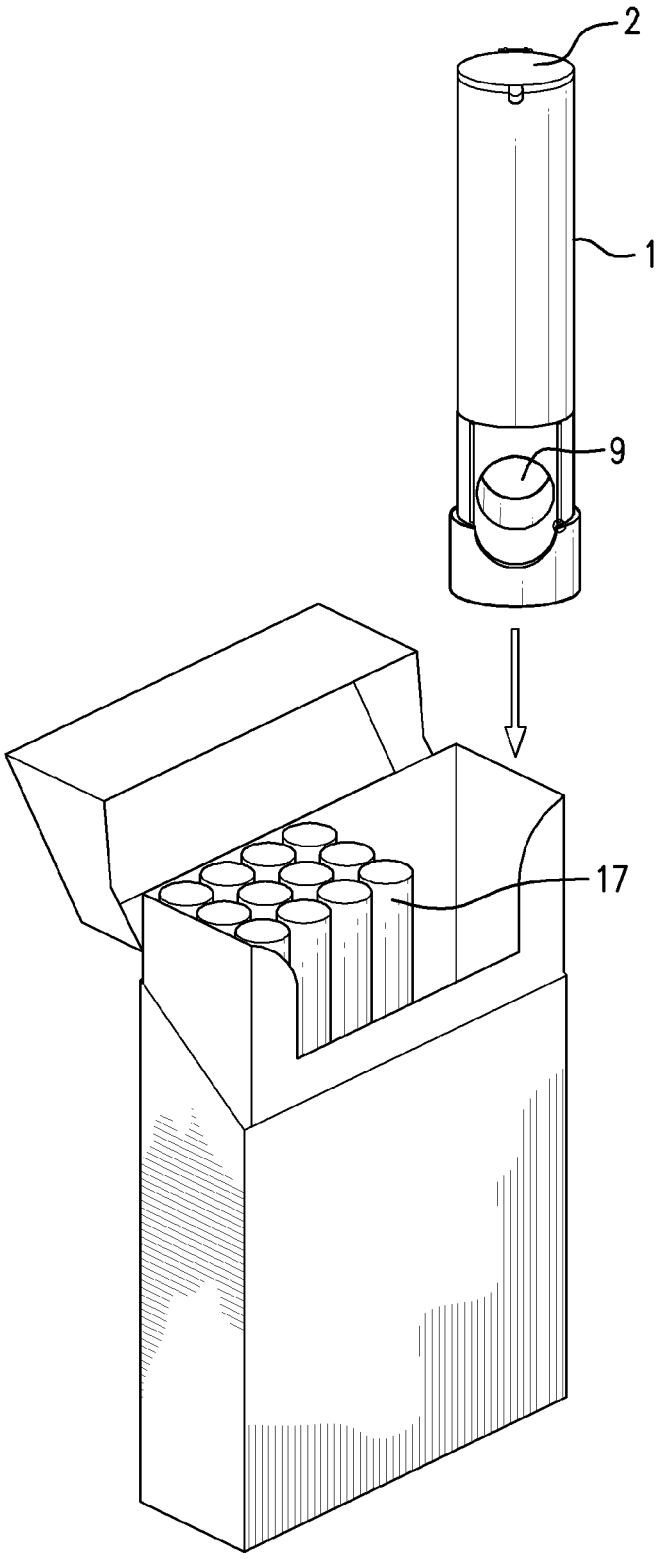
FIG. 9 is an exploded view, in perspective, showing how the apparatus of FIG. 1 can be inserted into a pack of cigarettes.

Referring to FIGS. 5, 6 and 7, the completely assembled cutting mechanism comprises two parts. The first part is the top portion of the cutting mechanism which is shown in FIG. 6. The second part is the bottom portion of the cutting mechanism which is shown in FIG. 7. Hole or opening 9 is bored out of the top portion of the cutting mechanism so unfinished cigarette 10 (or smoking material) can be inserted through hole 9. The unfinished cigarette 10 or (smoking material) may be extinguished before it is inserted in hole 9 for the cut. Once the burnt portion of the cigarette is cleanly cut off, the unfinished cigarette 10 or smoking material can be placed in the sealed storage compartment 1 and closed shut by simply pressing down on the tab 3 and vertical pop-up lid 2 simultaneously. This process is shown in FIG. 8. The smoker may now place the apparatus of the present invention having the unfinished cigarette 10 stored therein back into the box of unused cigarettes 17. This process is shown in FIG. 9. The top portion of the cutting mechanism, shown in FIG. 6, has two interior tracks 11 and four exterior tracks 12. The two interior tracks 11 are in place so they can house two springs 13 and two guide hooks 15. The two springs 13 rest inside the two interior tracks 11. The two blade guide hooks 15 are located on each side of the steel blade 14 as shown in FIG. 7. The two blade guide hooks 15 are set inside the bottom end of the two interior tracks 11. The two blade guide hooks 15 push the two springs 13 up and down the inside of the two interior tracks 11. These two blade guide hooks 15 also allow the steel blade 14 to retract up and down through the center of the bored out hole 9. As shown in FIG. 7, the steel blade 14 is mounted at the base of the bottom portion of the cutting mechanism on the inside. Four supporting hooks 16 are injection molded into the bottom portion of the cutting mechanism. The four supporting hooks 16 are set inside the bottom of the four exterior tracks 12. The four supporting hooks 16 slide inside the four exterior tracks 12. These four supporting hooks 16 are used to add more strength when the bottom portion of the cutting mechanism (see FIG. 7) and the top portion of the cutting mechanism (see FIG. 6) are connected together. The four supporting hooks 16 also help guide the steel blade 14 up and down through the center of the bored out hole 9.

Sealed storage compartment 1 and vertical pop-up lid 2 may be configured to have any type of suitable shape, e.g. rounded, square, rectangular, triangular etc. In a preferred embodiment, vertical pop-up lid 2 has a substantially round shape and sealed storage compartment 1 has a substantially cylindrical shape.

Parts of the apparatus of the present invention may be made of various materials such as plastics and metals. Suitable plastics include polymeric and rubbery materials, polystyrenic materials, etc. Suitable metals include aluminum, copper, bronze, brass or mild steel. In a preferred embodiment, all the parts of the apparatus of the present, except for the blade 14 and the two springs 13, are injection molded. In a preferred embodiment, blade 14 and springs 13 are fabricated from stainless steel to help avoid tarnish, rust or stains.

Figure 10:
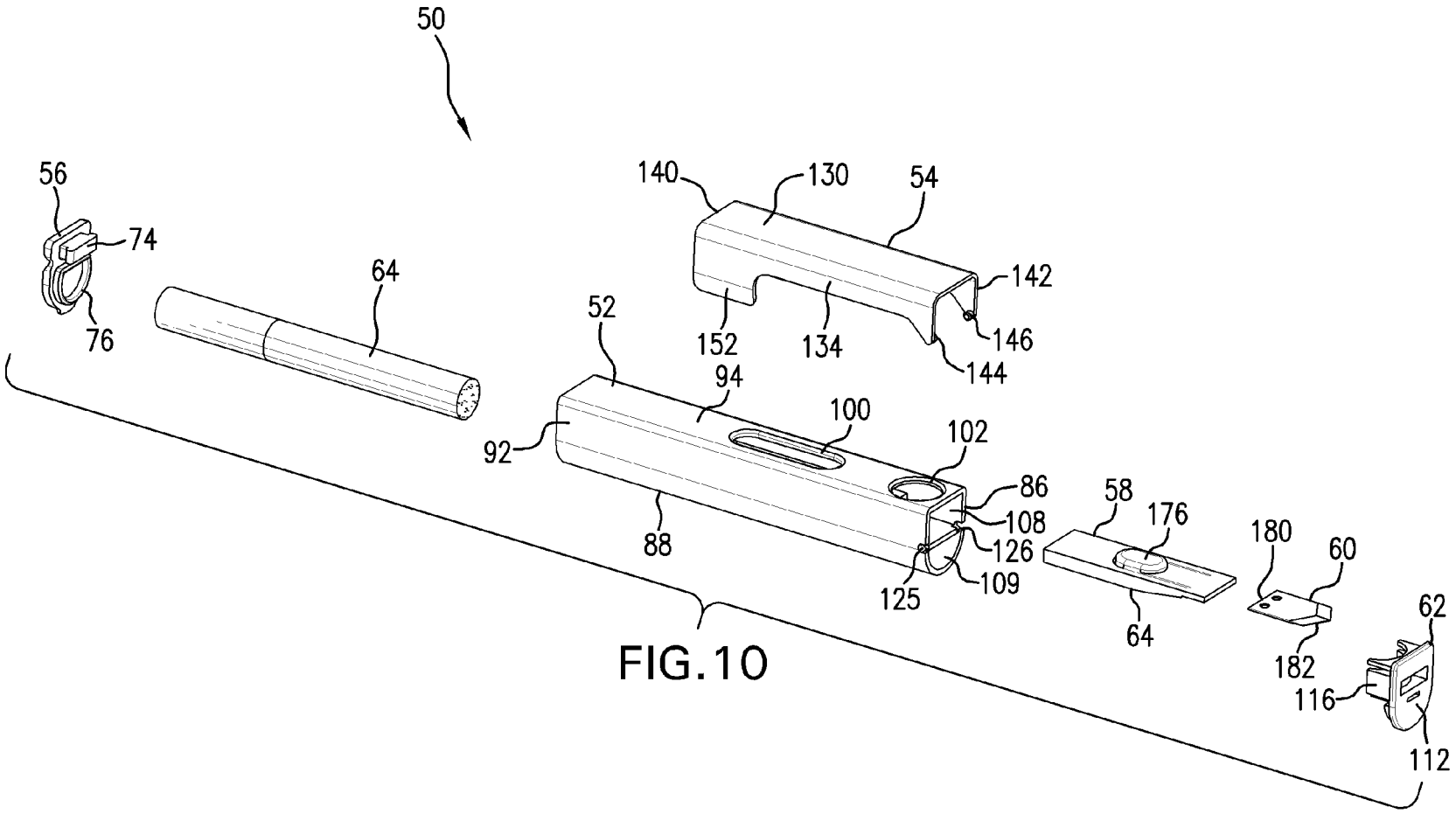
FIG. 10 is an exploded view, in perspective, of an apparatus for cutting and storing a cigarette in accordance with another embodiment of the present invention.
Figure 11A:
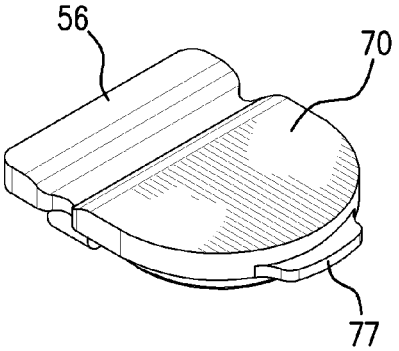
FIGS. 11A and 11B are perspective views of a top cap of the apparatus of FIG. 10, the views showing the top side of the top cap.
Figure 11B:
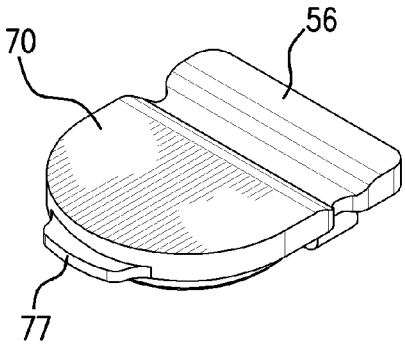
Figure 11C:
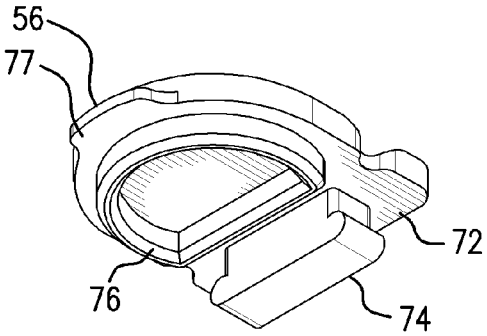
FIGS. 11C and 11D are perspective views of the top cap of the apparatus of FIG. 10, the views showing the bottom side of the top cap.
Figure 11D:
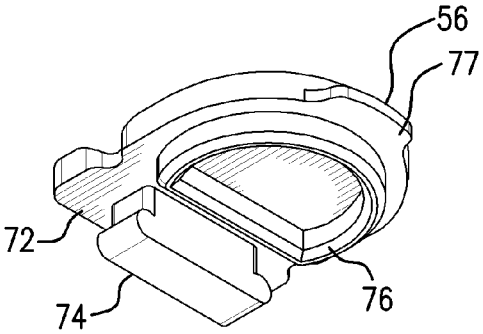
Figure 11E:
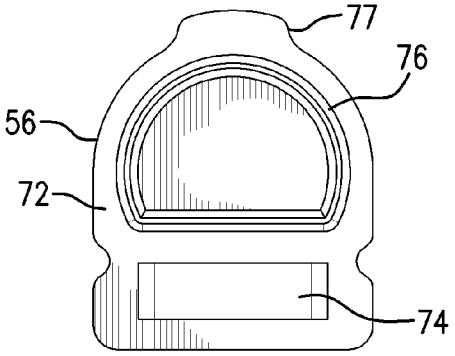
FIG. 11E is a view of the bottom side of the top cap.
Figure 11F:
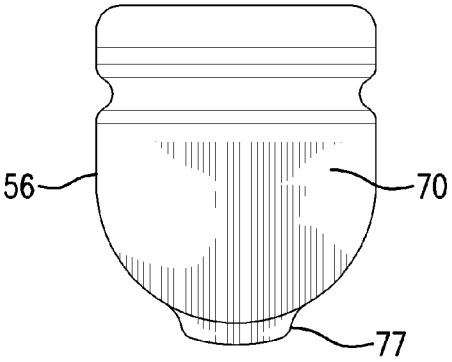
FIG. 11F is a view of the top side of the top cap.
Figure 11G:
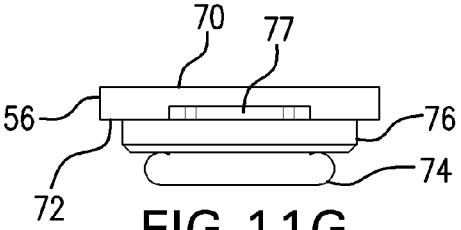
FIG. 11G is a front view of the top cap.
Figure 12A:
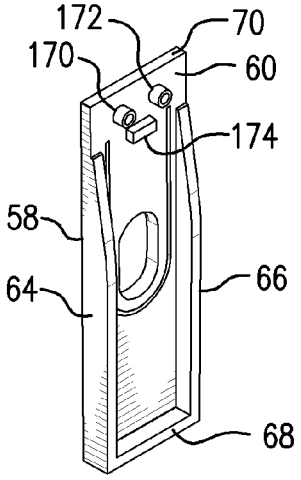
FIGS. 12A, 12B, 12C and 12D are perspective views of a blade holder shown in FIG. 10.
Figure 12B:
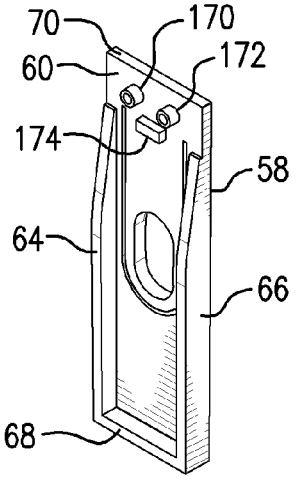
Figure 12C:
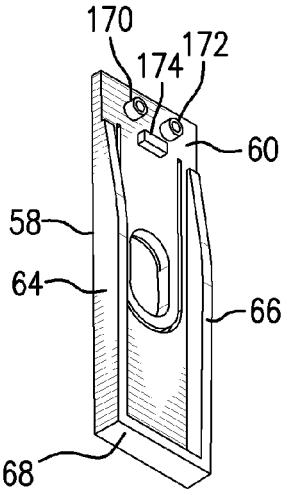
Figure 12D:
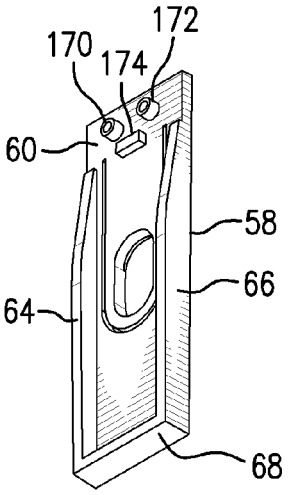
Figure 12E:
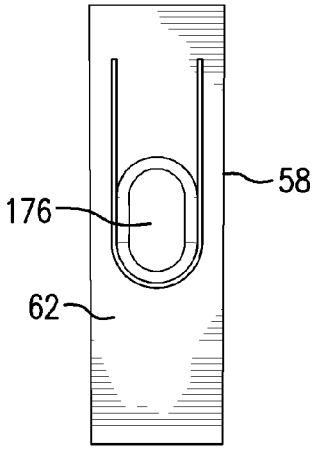
FIG. 12E is a front view, in elevation, of the blade holder shown in FIG. 12A.
Figure 12F:
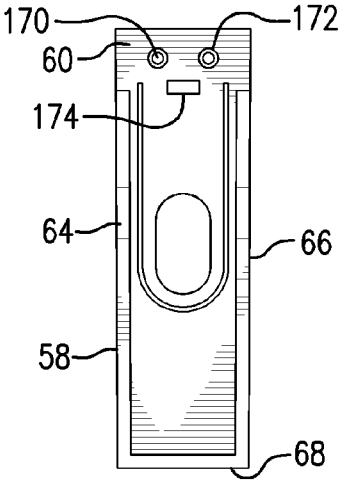
FIG. 12F is a rear view, in elevation, of the blade holder shown in FIG. 12A.
Figure 12G:
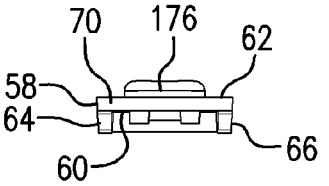
FIG. 12G is an end view of the blade holder shown in FIG. 12A, the view showing the blade holder right-side up.
Figure 12H:
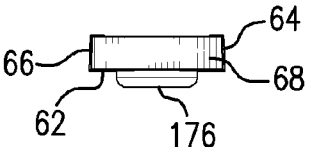
FIG. 12H is an end view of the blade holder shown in FIG. 12A, the view showing the blade holder up-side down.
Figure 12I:
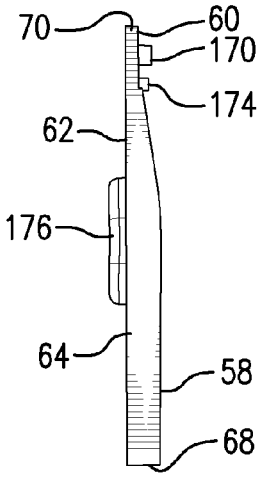
FIG. 12I is a side view, in elevation, of the blade holder shown in FIG. 12A.

Referring to FIG. 10, there is shown apparatus 50 in accordance with another embodiment of the present invention. Apparatus 50 is configured to cut and store a cigarette. In a preferred embodiment, apparatus 50 is sized to fit into a pack of cigarettes. Apparatus 50 generally comprises housing 52, cover 54, top cap 56, blade holder 58, blade 60 and bottom cap 62. Housing 52 has an interior compartment that is sized to receive cigarette 64. Cigarette 64 can be completely inserted into the interior compartment of housing 52. This feature will be described in detail in the ensuing description. Referring to FIGS. 11A-G, top cap 56 has top side 70 and bottom side 72. Bottom side 72 includes downwardly extending portion 74 and rib 76. Top cap 56 also has extending portion 77 which aids the user in removing top cap 56 from housing 52.

Figure 13A:
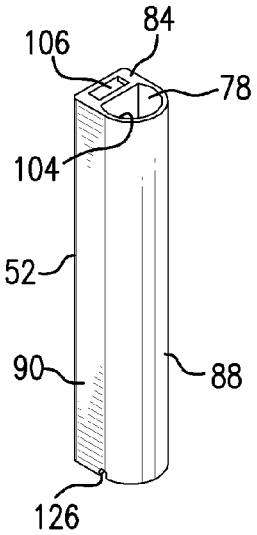
FIGS. 13A, 13B, 13C and 13D are perspective views of a housing shown in FIG. 10.
Figure 13B:
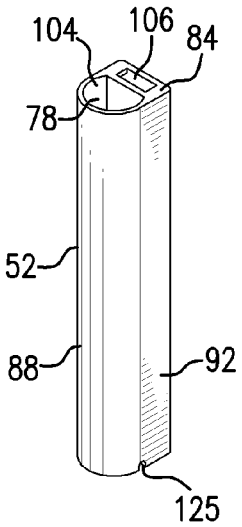
Figure 13C:
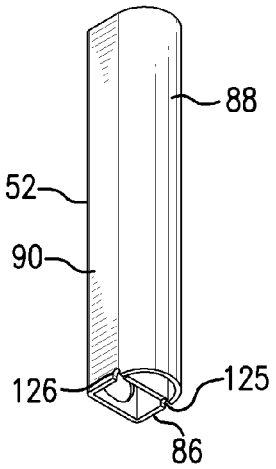
Figure 13D:
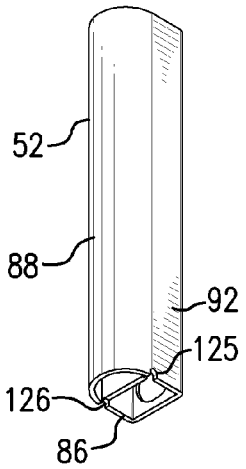
Figure 13E:
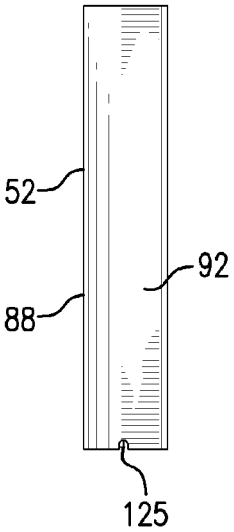
FIG. 13E is a side view, in elevation, of the housing shown in FIG. 13A.
Figure 13F:
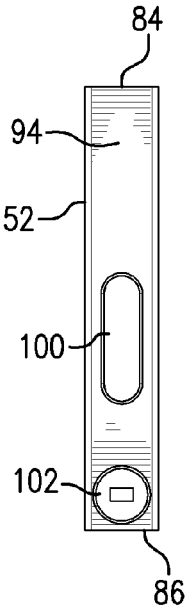
FIG. 13F is a front view, in elevation, of the housing shown in FIG. 13A.
Figure 13G:
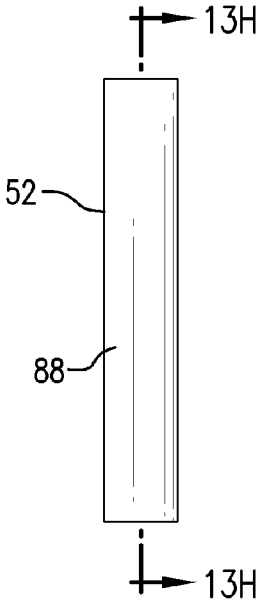
FIG. 13G is a rear view, in elevation, of the housing shown in FIG. 13A.
Figure 13H:
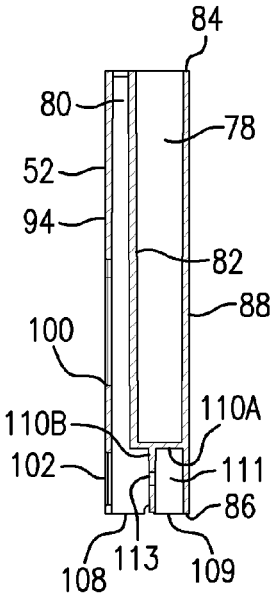
FIG. 13H is a view taken along line 13H-13H of FIG. 13G.
Figure 13I:
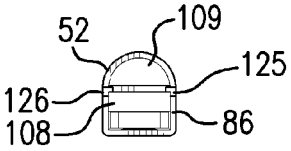
FIG. 13I is a bottom view of the housing shown in FIG. 13A.
Figure 13J:
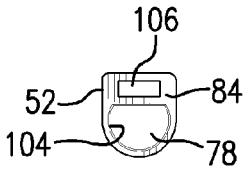
FIG. 13J is a top view of the housing shown in FIG. 13A.
Figure 14A:
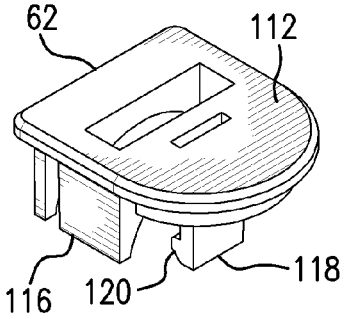
FIGS. 14A and 14B are perspective views of a bottom cap that is shown in FIG. 10, the views showing an exterior side of the bottom cap.
Figure 14B:
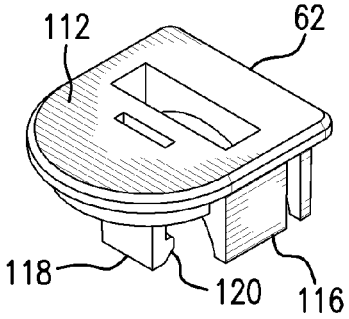
Figure 14C:
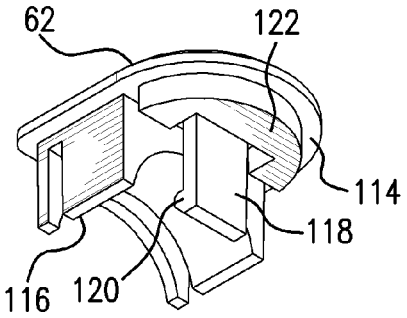
FIGS. 14C and 14D are perspective views of the bottom cap shown in FIG. 14A, the views showing the interior side of the bottom cap.
Figure 14D:
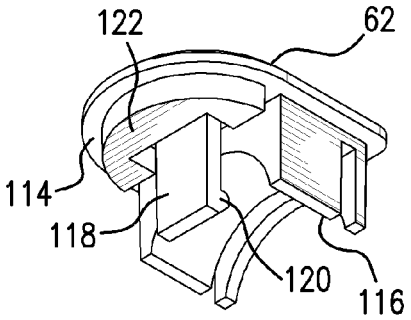
Figure 14E:
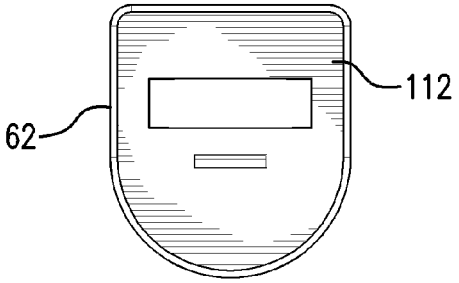
FIG. 14E is a plan view of the exterior side of the bottom cap shown in FIG. 14A.
Figure 14F:
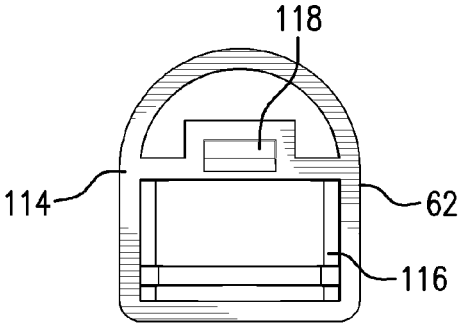
FIG. 14F is a plan view of the interior side of the bottom cap shown in FIG. 14A.
Figure 14G:
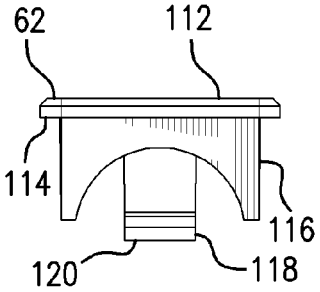
FIG. 14G is a front end view of the bottom cap shown in FIG. 14A.
Figure 14H:
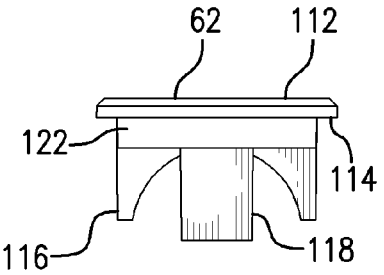
FIG. 14H is a rear end view of the bottom cap shown in FIG. 14A.
Figure 14I:
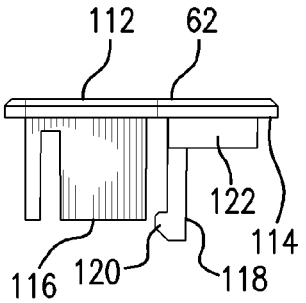
FIG. 14I is a side view of the bottom cap shown in FIG. 14A.
Figure 15A:
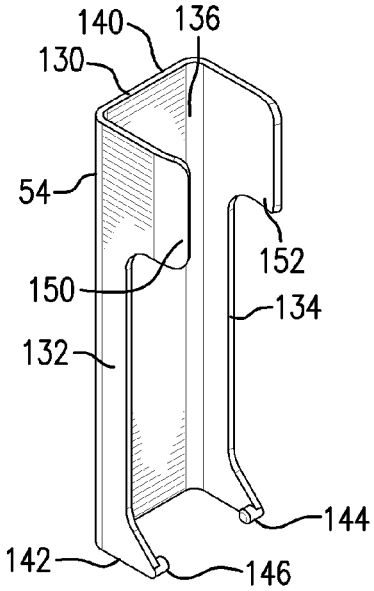
FIGS. 15A and 15B are perspective views of a cover shown in FIG. 10.
Figure 15B:
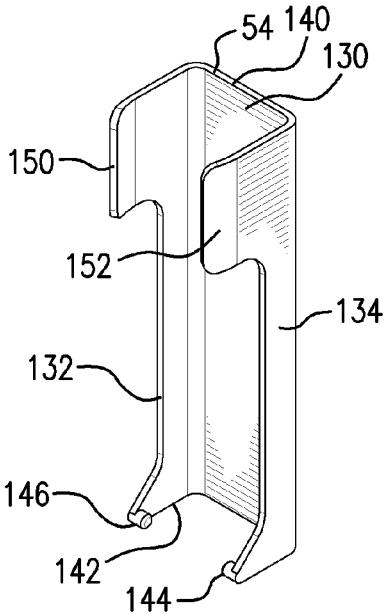
Figure 15C:
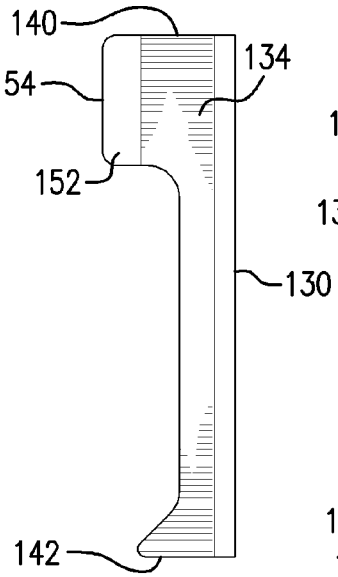
FIG. 15C is a side view, in elevation, of the cover shown in FIG. 15A.
Figure 15D:
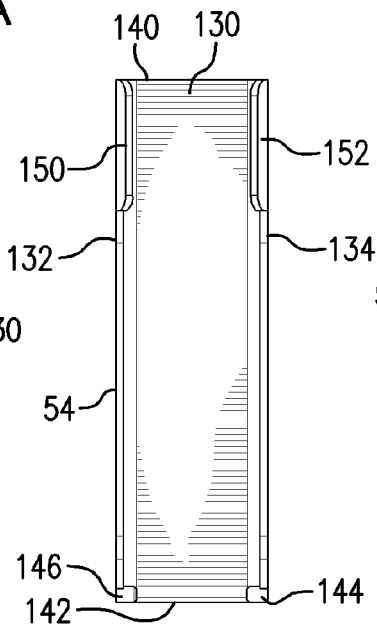
FIG. 15D is a view, in elevation, of the interior side of the cover shown in FIG. 15A.
Figure 15E:
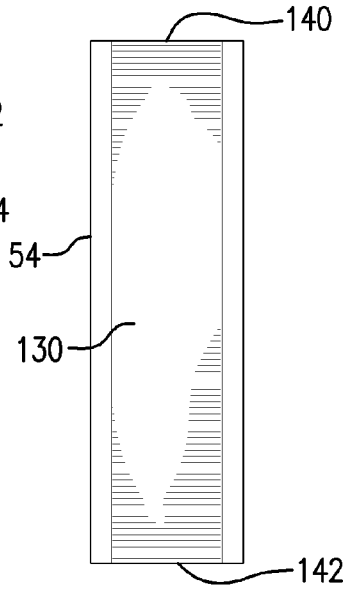
FIG. 15E is a view, in elevation, of the exterior side of the cover shown in FIG. 15A.
Figure 15F:
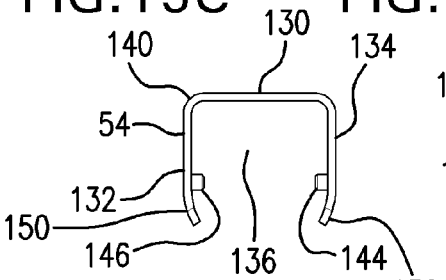
FIG. 15F is top view of the cover shown in FIG. 15A.
Figure 15G:
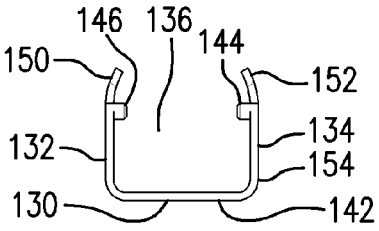
FIG. 15G is bottom view of the cover shown in FIG. 15A.
Figure 16A:
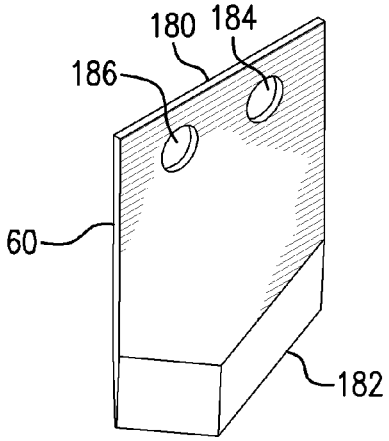
FIGS. 16A, 16B, 16C and 16D are perspective views of a blade shown in FIG. 10.
Figure 16B:
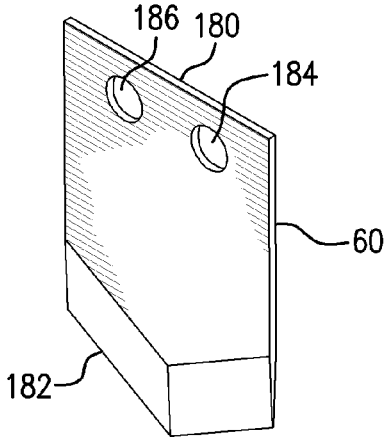
Figure 16C:
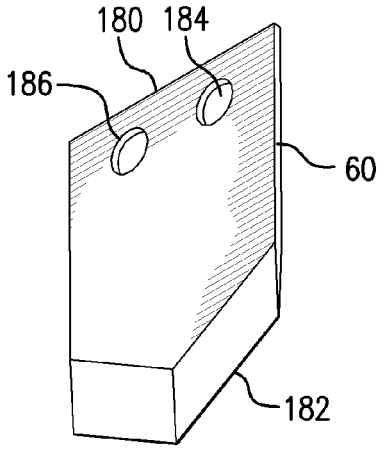
Figure 16D:
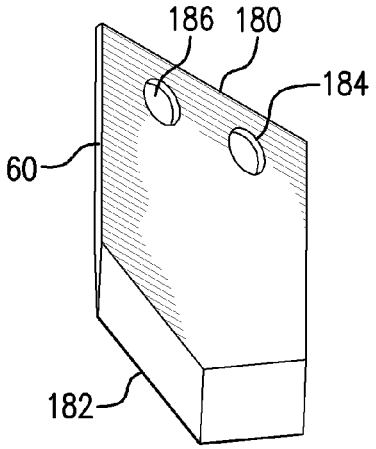
Figure 16E:
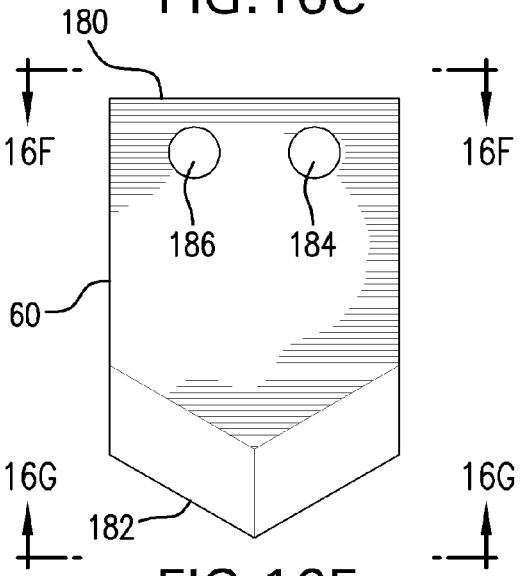
FIG. 16E is a front view of the blade shown in FIG. 16A.
Figure 16F:
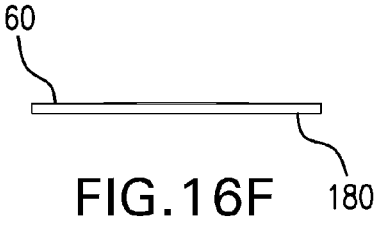
FIG. 16F is a view taken along line 16F-16F in FIG. 16E.
Figure 16G:
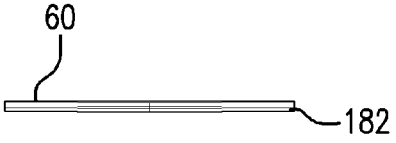
FIG. 16G is a view taken along line 16G-16G in FIG. 16E.
Figure 17A:
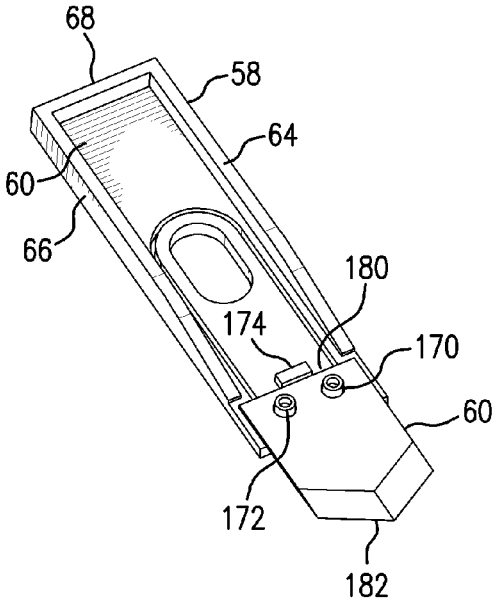
FIG. 17A is a perspective view showing the blade of FIG. 16A attached to the blade holder of FIG. 12A, the view showing an inner side of the blade holder.
Figure 17B:
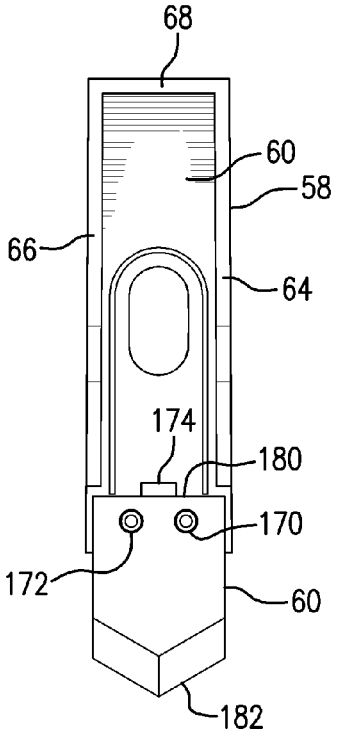
FIG. 17B is a view, in elevation, showing the blade of FIG. 16A attached to the blade holder of FIG. 12A, the view showing the inner side of the blade holder.
Figure 17C:
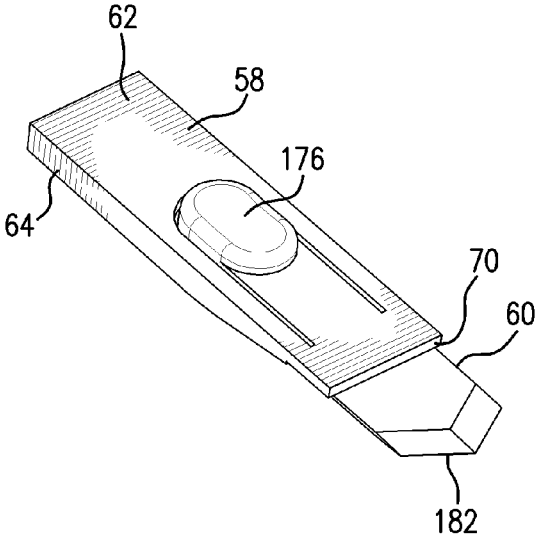
FIG. 17C is a perspective view showing the blade of FIG. 16A attached to the blade holder of FIG. 12A, the view showing the outer side of the blade holder.
Figure 17D:
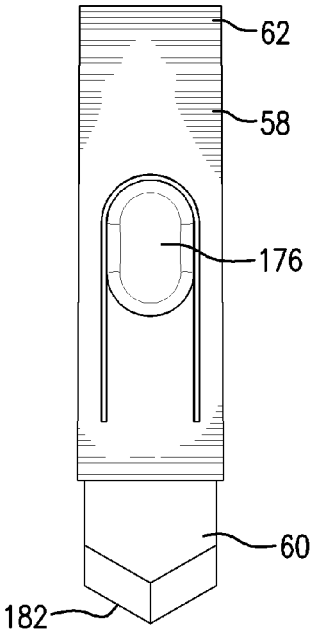
FIG. 17D is a view, in elevation, showing the blade of FIG. 16A attached to the blade holder of FIG. 12A, the view showing the outer side of the blade holder.

Referring to FIGS. 13A-J, housing 52 has interior compartment 78 that is sized to receive cigarette 64 (see FIG. 13H). The size of interior compartment 78 allows cigarette 64 to be completely inserted therein. Housing 52 has additional interior compartment 80 that is separated from interior compartment 78 by interior wall 82. Interior compartment 80 has a size that is relatively smaller than the size of interior compartment 78. As will be explained in the ensuing description, blade holder 58 and blade 60 are disposed within interior compartment 80. Housing 52 has top end 84 and bottom end 86. Housing 52 also has rounded portion 88 and side portions 90 and 92, and substantially flat portion 94. Housing 52 has openings 100 and 102 formed in substantially flat portion 94. Opening 100 extends longitudinally for a predetermined distance along substantially flat portion 94. Opening 102 is generally round in shape and is adjacent to bottom end 86. Openings 100 and 102 are in communication with interior compartment 80. Housing 52 includes opening 104 that is in top end 84 of housing 52 and is in communication with interior compartment 78. Housing 52 also includes slot or rectangular shaped opening 106. Referring to FIGS. 11C, 11D, 13A, 13B and 13J, portion 74 of top cap 56 is sized to frictionally fit into slot 106. Rib portion 76 of top cap 56 is sized to frictionally fit into opening 104 in housing 52. Housing 52 further includes openings 108 and 109 located at bottom end 86 of housing 52. Opening 108 is in communication with interior compartment 80. Opening 109 is not in communication with interior compartment 78 due to interior wall 110A. Interior walls 110A and 110B and the outer wall of housing 52 define an additional compartment 111. Referring to FIGS. 14A-I, bottom cap 62 has exterior side 112 and interior side 114. Bottom cap 62 includes guide structure 116 on interior side 114. Guide structure 116 is sized to frictionally fit into opening 108 of housing 52. Bottom cap 62 further includes extending member 118 on interior side 114. Extending member 118 has end portion 120. End portion 120 is sized to fit into opening 113 in interior wall 110B. Extending member 118 has a slight degree of resiliency and is positioned on interior side 114 at a predetermined position so that when extending member 118 is positioned within opening 109, end portion 120 frictionally contacts interior wall 110B and becomes disposed within opening 113 in interior wall 110B. Bottom cap 62 also includes a generally semi-circular rib 122 that is on interior side 114. Semi-circular rib 122 is sized to frictionally fit into opening 109. As shown in FIGS. 10, 13A-F and 13I, housing 52 includes notches 125 and 126 at end 86. The purpose of notches 125 and 126 is discussed in the ensuing description.

Referring to FIGS. 10, 15A-G and 18, cover 54 is hingedly or pivotally attached to housing 52. Cover 54 has general planar member 130, sides 132 and 134, and interior region 136. Cover 54 has top end 140 and bottom end 142. Cover 54 further includes tabs 144 and 146 that are located on the bottom end 142. Tabs 144 and 146 are sized to be press-fitted into notches 125 and 126, respectively, of housing 52. Tabs 144, 146 and notches 125,126 cooperate to function as hinges and enables cover 54 to be hingedly attached to housing 52. This allows cover 54 to be moved to a closed position or an opened position. When in the closed position, cover 54 covers openings 100 and 102. When cover 54 is in the opened position, openings 100 and 102 are exposed and accessible. As shown in FIGS. 15A, 15B, 15D, 15F and 15G, sides 132 and 134 include portions 150 and 152, respectively, which curve inward. As cover 54 is being moved to the closed position, portions 150 and 152 frictionally contact sides 90 and 92, respectively, of housing 52. When cover 54 is completely closed, portions 150 and 152 are in frictional contact with rounded portion 88 of housing 52, and a portion of housing 52 is within interior region 136 of cover 54. Thus, the frictional contact between portions 150, 152 and rounded portion 88 keeps cover 54 in the closed position until a user desires to open cover 54. A user opens cover 54 by using his or her finger to pry end 140 away from flat portion 94 of housing 52. The user needs to use a force that is sufficient to counteract the frictional contact between housing 52 and portions 150, 152 of cover 54.

Referring to FIGS. 10, and 12A-I, there is shown blade holder 58. Blade holder 58 has inner side 60, outer side 62 and wall sections 64, 66 and 68. Blade holder 58 also has end 70. Blade holder 58 further includes protrusions 170, 172 and 174, the purpose of which is discussed in the ensuing description. Blade holder 58 has a raised portion 176 that is located on outer side 62. Raised portion 176 functions as a knob as will be described in the ensuing description. Raised portion 176 has a shape that corresponds to the shape of opening 100 in housing 52. Raised portion 176 is configured to have a size that enables raised portion 176 to fit within opening 100 and move longitudinally within opening 100. Referring to FIGS. 16A-G, there is shown blade 60. Blade 60 has top edge 180 and cutting edge 182. Blade 60 includes openings 184 and 186. Referring to FIGS. 17A-D, the purpose of openings 184 and 186 is to receive protrusions 170 and 172, respectively, of blade holder 58. Protrusions 170 and 172 of blade holder 58 are sized to be frictionally inserted into openings 184 and 186, respectively, of blade 60. Edge 180 abuts protrusion 174 when protrusions 170 and 172 are completely inserted into openings 184 and 186, respectively. In one embodiment, blade 60 is attached to protrusions 170 and 172 by a heat staking process. In an alternate embodiment, heat staking is not used and blade 60 is encapsulated within a portion of blade holder 58 during the manufacturing process.

Figure 18:
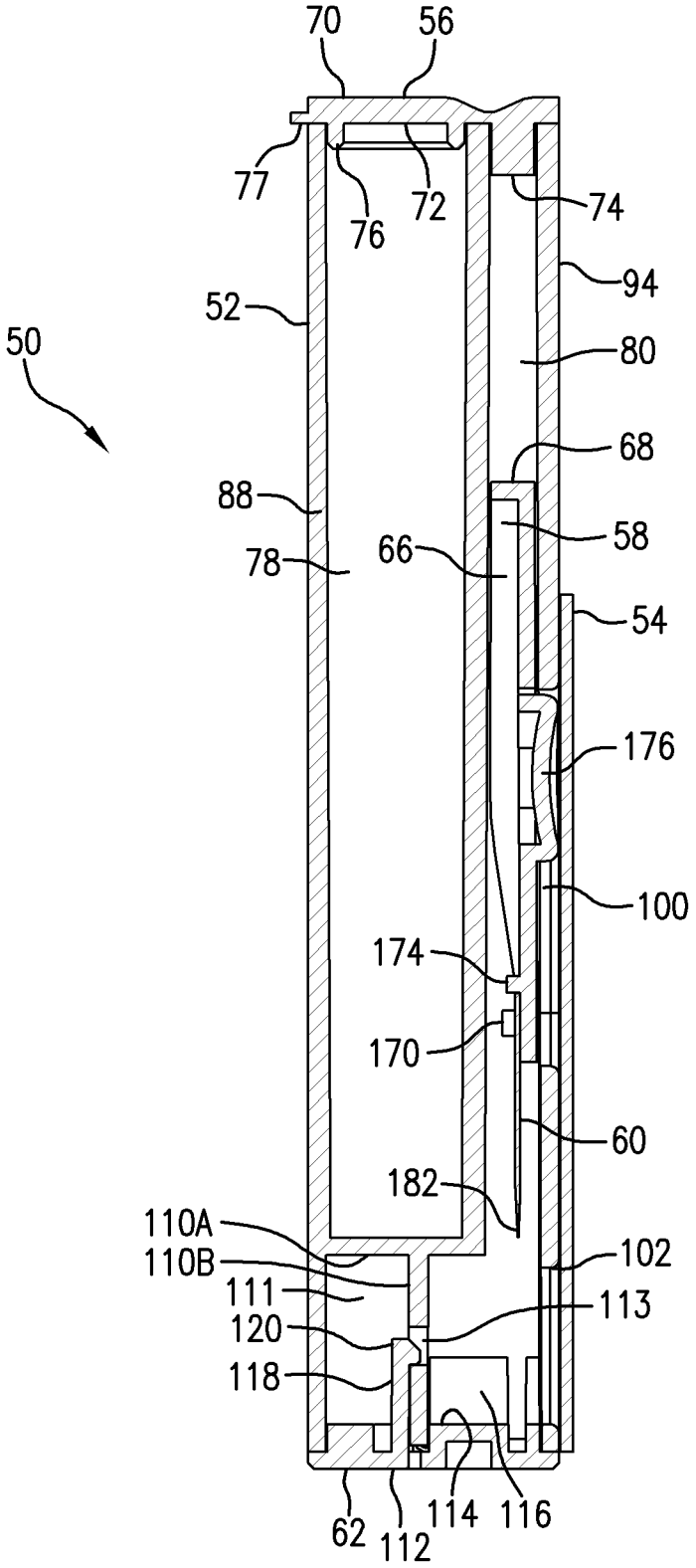
FIG. 18 is a cross-sectional view, in elevation, of the apparatus of FIG. 10 completely assembled.

Referring to FIG. 18, there is shown a cross-sectional view of apparatus 50 completely assembled. Cover 54 is in the closed position. Blade holder 58 is movably positioned within interior compartment 80. Blade 60 is attached to blade holder 58. Blade holder 58, and thus blade 60, can move longitudinally a predetermined distance that is determined by the length of opening 100. Raised portion 176 is located within opening 100 in housing 52 and contacts the edges of opening 100. Since cover 54 is in the closed position, cover 54 conceals openings 100 and 102 in housing 52 and raised portion 176. When the user desires to cut off a burnt portion of an unfinished cigarette (i.e. the portion of the cigarette with the ashes), the user flips cover 54 into the opened position. A user, using one of his or her fingers, contacts raised portion 176 and slides blade holder 58, and hence blade 60, in the direction of top cap 56 in order to ensure that blade 60 will not block the insertion of the end of the unfinished cigarette into opening 102. Next, the user inserts the burnt end of the unfinished cigarette into opening 102. Next, the user then contacts raised portion 176 and slides blade holder 58 in the direction of bottom cap 62 so that blade 60 cuts off the burnt portion of the unfinished cigarette. The user then removes the unfinished cigarette from opening 102 and flips open top cap 56. The user then inserts the unfinished cigarette into the interior compartment 78. The user then re-attaches top cap 56 to housing 52. Since interior compartment 80 is isolated from interior compartment 78, none of the ashes or burnt portion of the cigarette enter interior compartment 78. In the event the user wishes to clean the ashes or debris from interior compartment 80, the user gently shakes apparatus 50 so that the ashes and burnt portion of the cigarette falls through opening 102. The user can then close cover 54 and insert apparatus 50 into a pack of cigarettes. Since interior compartments 78 and 80 are sealed when top cap 56 is closed, the unused portion of the cigarette in interior compartment 78 and any debris in interior compartment 80 can never taint or spoil the cigarettes in the pack of cigarettes.

In alternate embodiment, bottom cap 62 is removable from housing 52 so that the ashes and burnt portion of the cigarette can fall out from opening 108.

Apparatus 50 may be fabricated from a variety of suitable materials. For example, with the exception of blade 60, the components of apparatus 50 may be fabricated from plastic. If the components of apparatus 50 are to be fabricated from plastic, then it is preferable that injection molding be used.

The size of apparatus of the present invention may be varied so it may be used in a variety of applications. For example, apparatus 50 may be increased in size so that it could be used with cigars.

Figure 28:
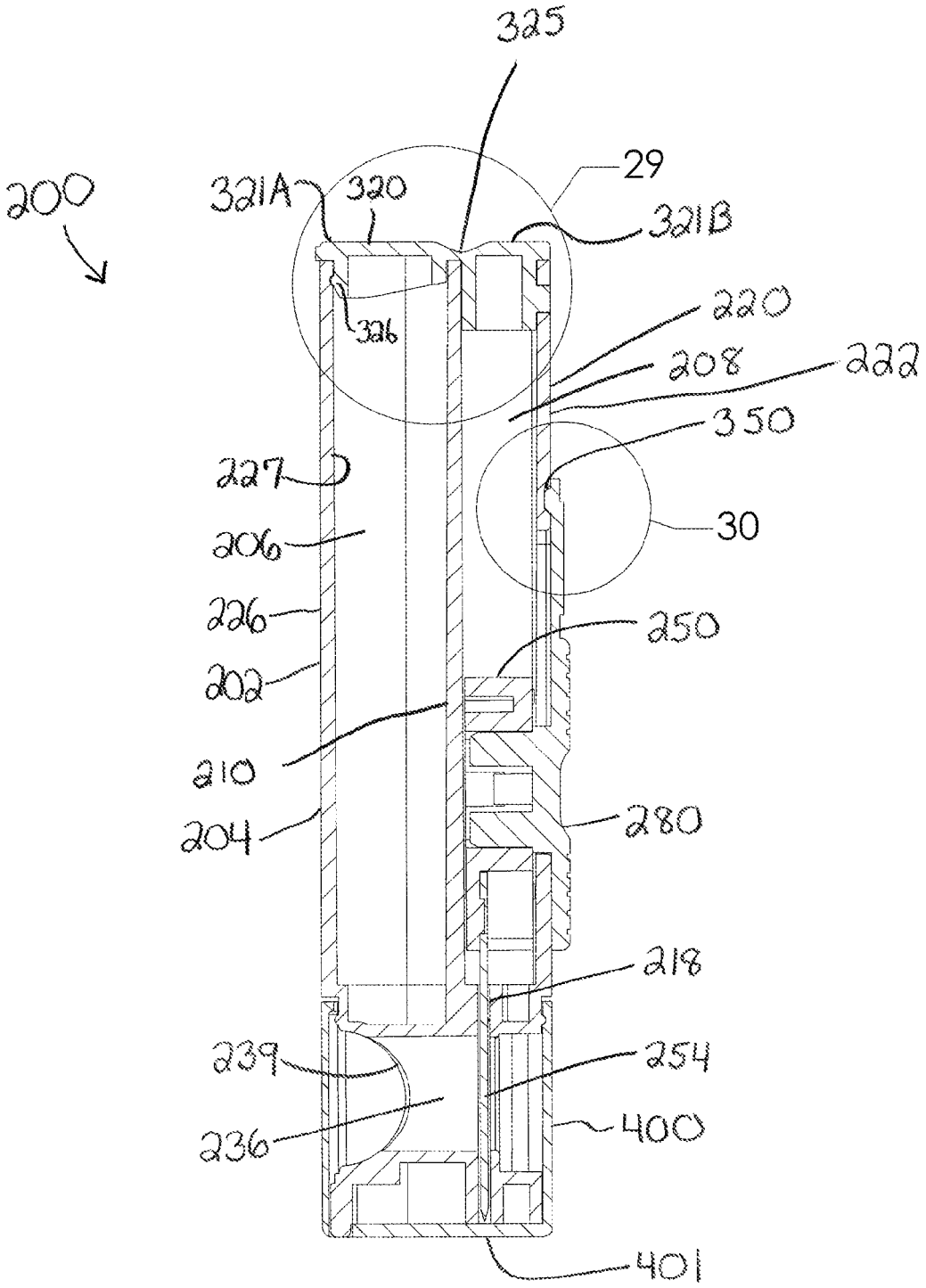
FIG. 28 is a cross-sectional view taken along line 28-28 of FIG. 27.

Referring to FIGS. 19-37, there is shown apparatus 200 in accordance with another embodiment of the invention. Apparatus 200 is directed to an apparatus for cutting away a used portion of a cigarette and storing the remaining portion of the cigarette. Apparatus 200 comprises housing 202 which has first housing section 204. First housing section 204 has first interior compartment 206 for storing a cigarette. First housing section 204 also includes second interior compartment 208 in which cutting device 250 is movably positioned (see FIG. 28). Compartments 206 and 208 are separate compartments and are separated by interior wall 210. First housing section 202 comprises first end 212 which has opening 214 that allows a cigarette to be inserted into or removed from compartment 206 (see FIG. 23). First housing section 204 has an opening 215 that leads to compartment 208. First housing section 204 further comprises second end 216 that is opposite first end 212. Second end 216 closes off compartment 206. Second end 216 has passageway 218 that leads to compartment 208 (see FIG. 28). Housing 202 has wall 220 that is a part of compartment 208. Wall 220 has exterior side 222 and opening 224 (see FIG. 20). Opening 224 is located between first end 212 and second end 216 of housing 202 and is in communication compartment 208. This means that a portion of compartment 208 is viewable through opening 224. Opening 224 has the shape of an elongated slot and longitudinally extends along wall 220. First housing section 204 includes opening 225 that is in proximity to end 212. The purpose of opening 225 is discussed in the ensuing description. First housing section 204 further includes wall 226 which forms first compartment 206 and which includes interior side 227 (see FIG. 28).

Figure 19:
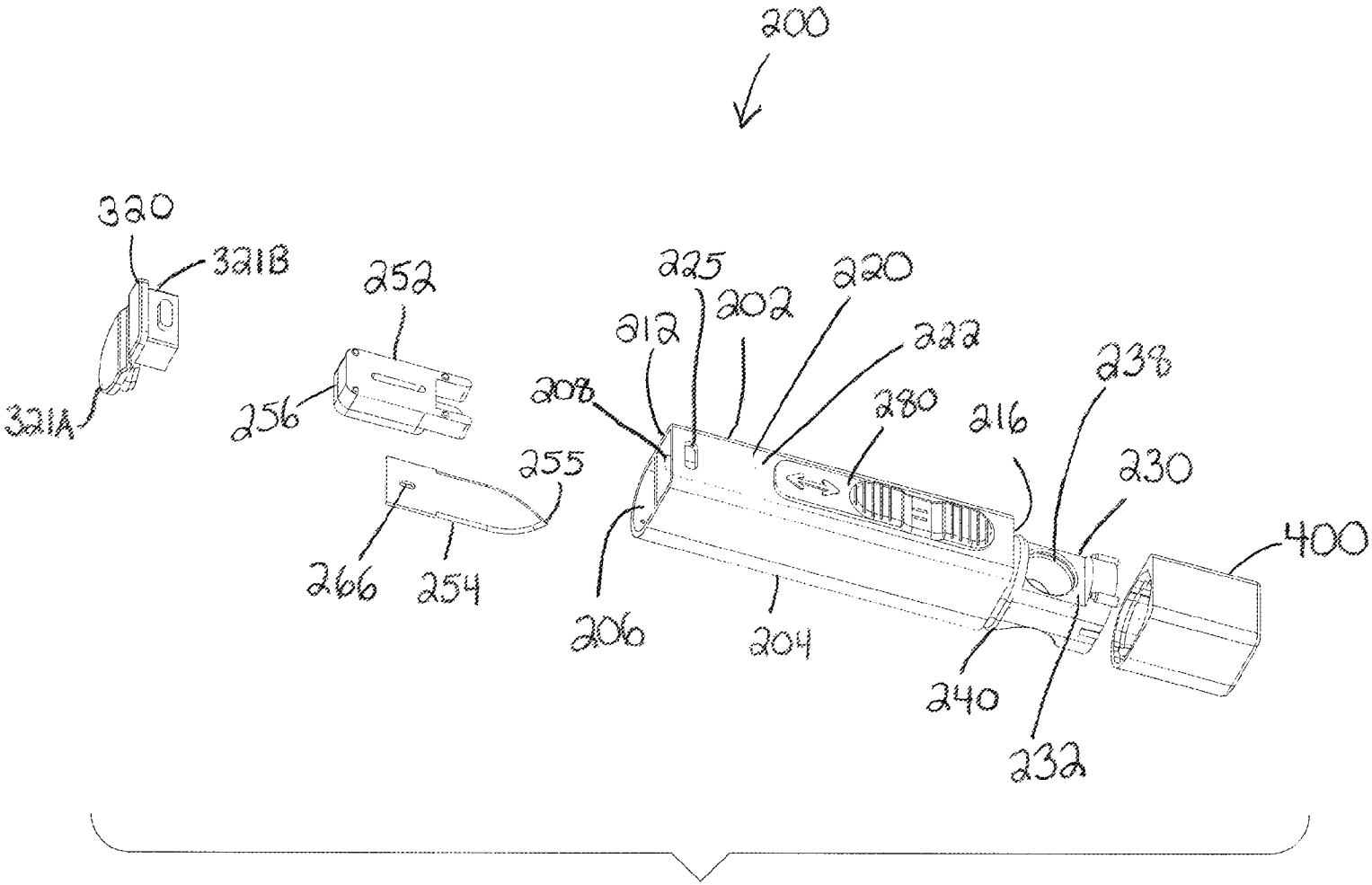
FIG. 19 is an exploded view of an apparatus for cutting and storing a cigarette in accordance with another embodiment of the invention.
Figure 20:
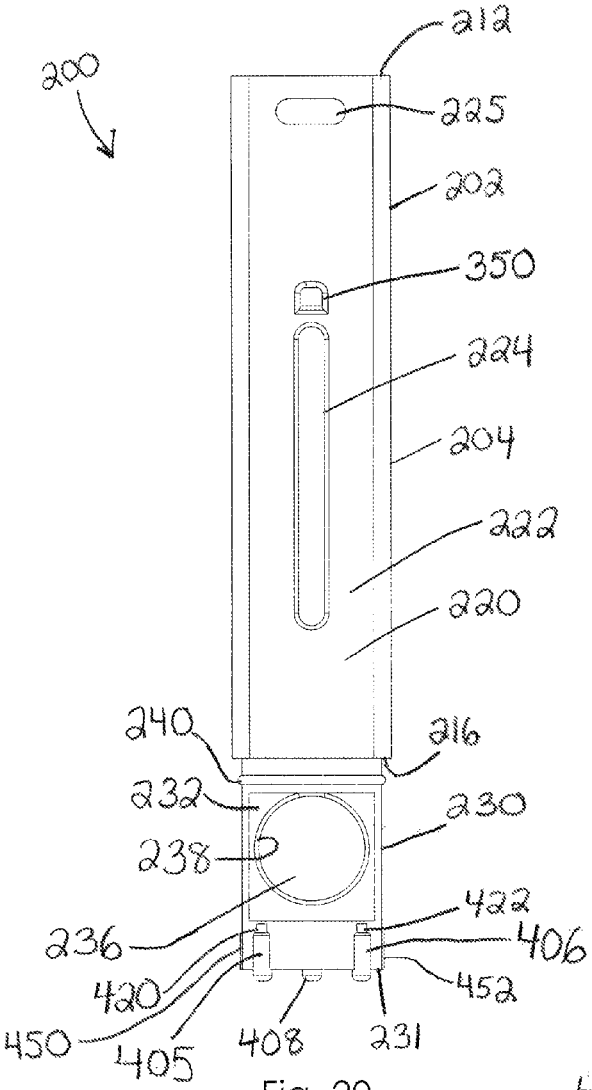
FIG. 20 is front view, in elevation, of a housing depicted in FIG. 19.
Figure 21:
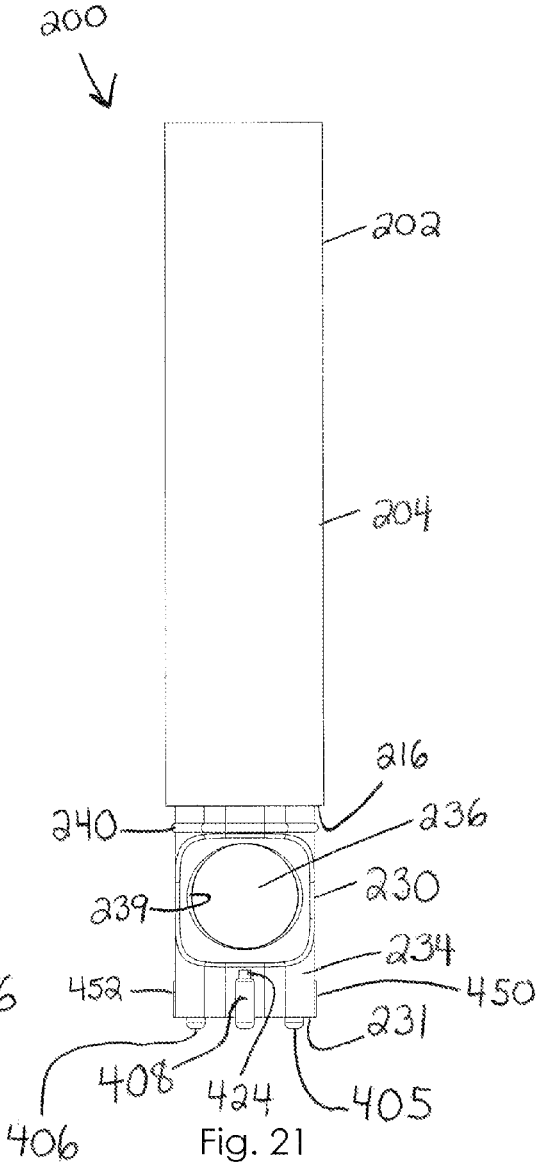
FIG. 21 is a rear view, in elevation, of the housing of FIG. 19.
Figure 22:
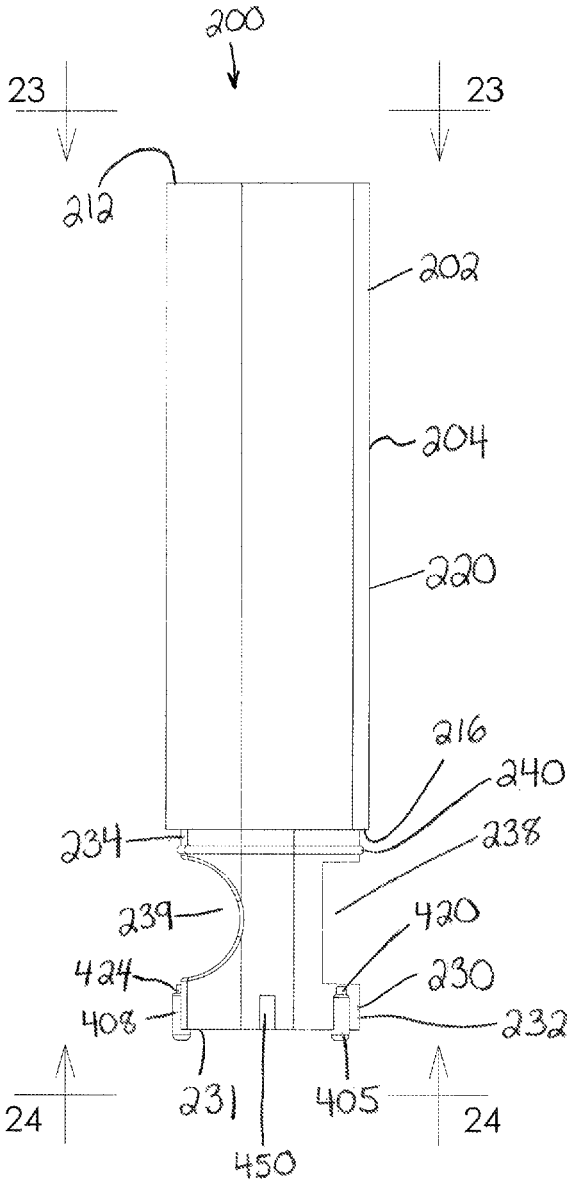
FIG. 22 is a side view, in elevation, of the housing of FIG. 19.

Housing 202 further comprises second housing section 230 joined to second end 216 of first housing section 204 (see FIGS. 19-21). Second housing section 230 has a front side 232, rear side 234, hollow interior 236 and opening 238 in front side 232. Opening 238 has a diameter that is large enough to receive a cigarette. Rear side 234 has opening 239 therein which is coaxial with opening 238 and has a diameter that is large enough to receive a cigarette. Openings 238 and 239 provide access to hollow interior 236. Thus, a cigarette can be inserted through opening 238 until a desired portion of the cigarette extends from opening 239. Passageway 218 is in communication with the hollow interior 236 (see FIG. 28). Second housing section 230 includes rib 240 that extends about second housing section 230. The purpose of rib 240 is described in the ensuing description.

Figure 50:
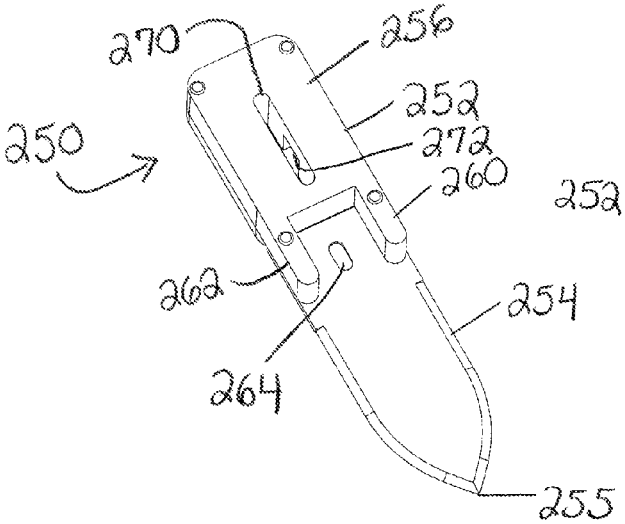
FIG. 50 is a perspective view, in elevation, that illustrates the interconnection of the blade and the blade holder, the view showing the front side of the blade holder.
Figure 51:
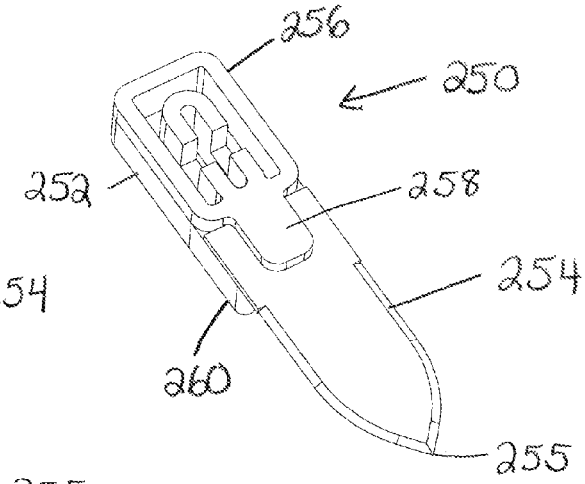
FIG. 51 is a perspective view, in elevation, that illustrates the interconnection of the blade and the blade holder, the view showing the rear side of the blade holder.
Figure 52:
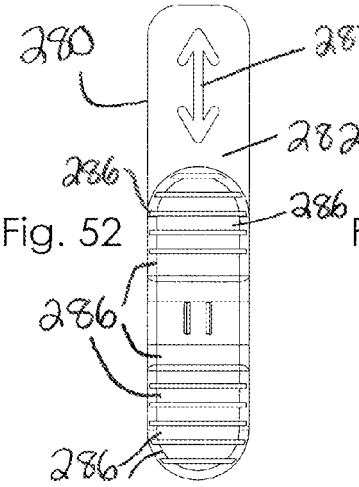
FIG. 52 is a front view, in elevation, of a slide-button shown in FIG. 19.
Figure 53:
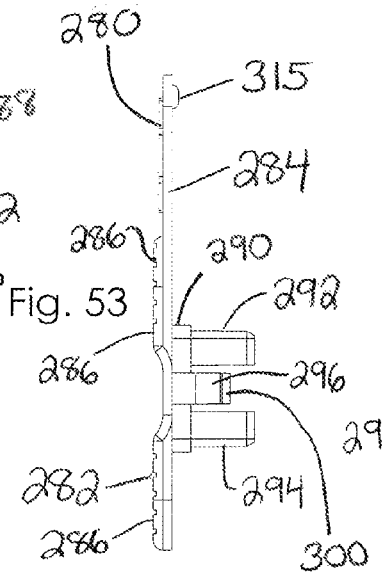
FIG. 53 is a side view, in elevation, of the slide-button, the view showing the left side of the slide-button.
Figure 54:
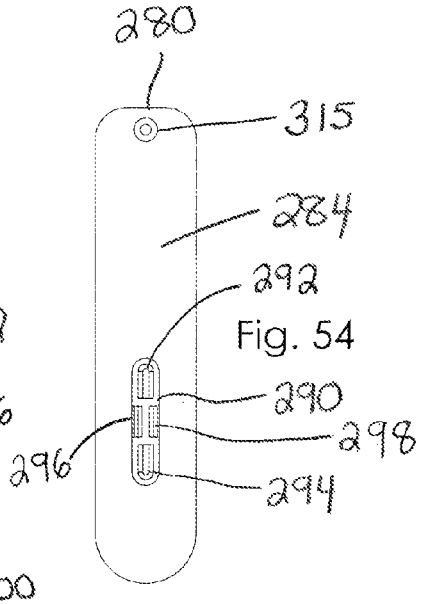
FIG. 54 is rear side, in elevation, of the slide-button.
Figure 55:
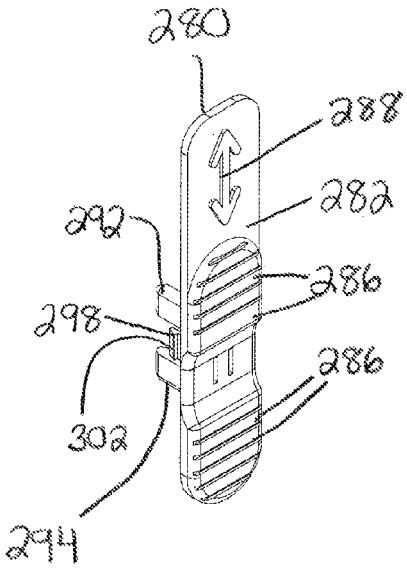
FIG. 55 is a perspective view of the slide-button, the view showing the front of the slide-button.
Figure 56:
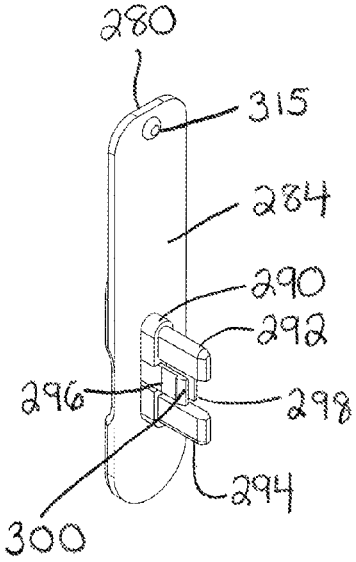
FIG. 56 is a perspective view of the slide-button, the view showing the rear of the slide-button.
Figure 57:
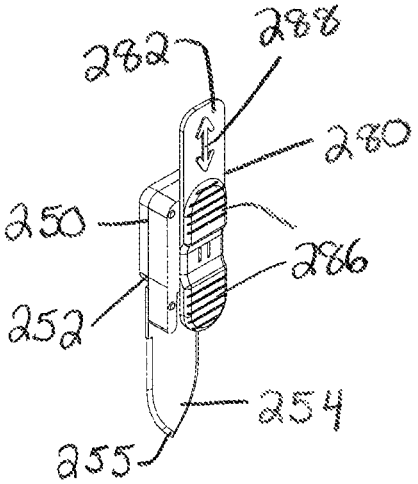
FIG. 57 is a perspective view illustrating the interconnection of the slide-button and the blade holder.
Figure 58:
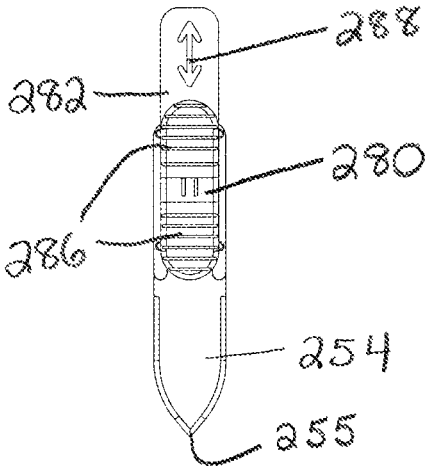
FIG. 58 is a front view, in elevation, illustrating the interconnection of the slide-button and the blade holder.
Figure 59:
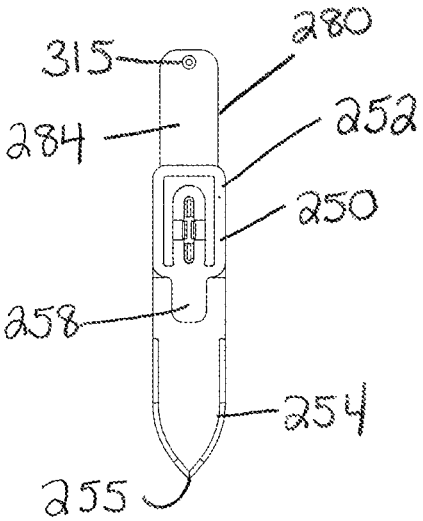
FIG. 59 is a rear view, in elevation, illustrating the interconnection of the slide-button and the blade holder.
Figure 60:
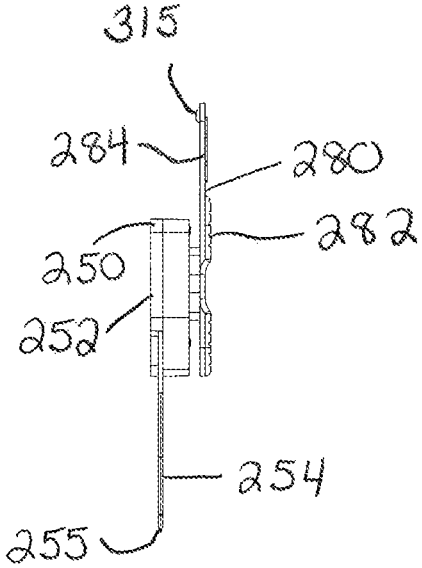
FIG. 60 is side view, in elevation, illustrating the interconnection of the slide-button and the blade holder.
Figure 61:
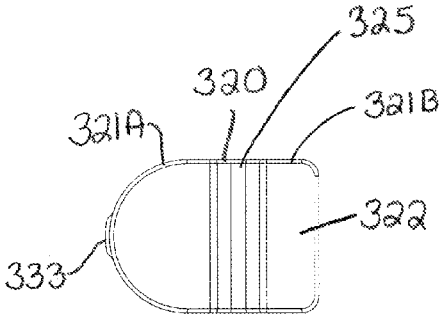
FIG. 61 is a top view of a top cap shown in FIG. 19.
Figure 64:
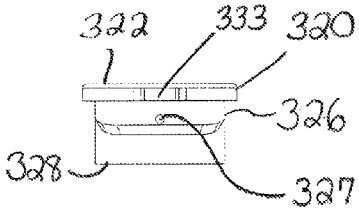
FIG. 64 is front view of the top cap.
Figure 62:
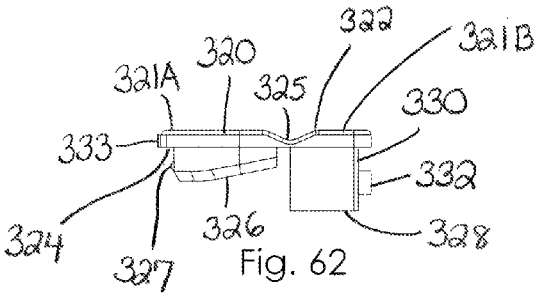
FIG. 62 is a side view of the top cap.
Figure 65:
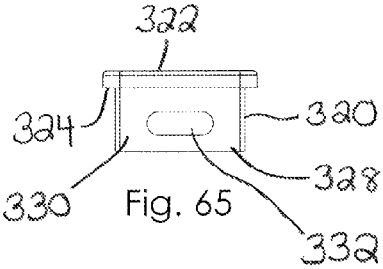
FIG. 65 is rear view of the top cap.
Figure 63:
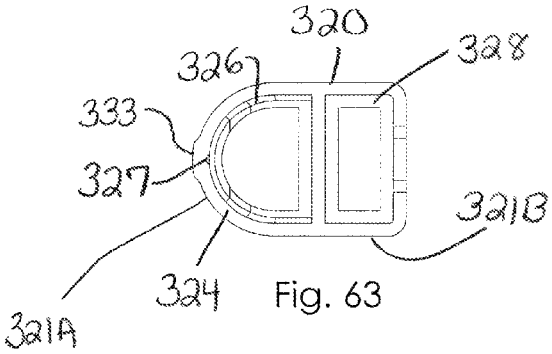
FIG. 63 is bottom view of the top cap.
Figure 66:
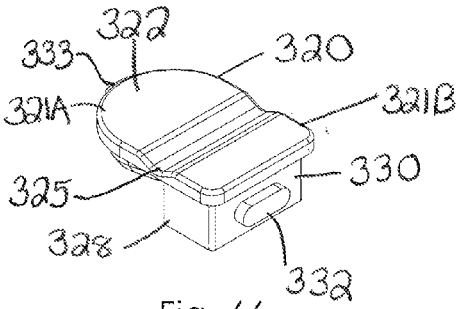
FIG. 66 is a perspective view of the top cap, the view showing the left and rear sides of the top cap.

Referring to FIGS. 38-51, apparatus 200 further comprises cutting device 250 that is movably positioned within compartment 208. Cutting device 250 can move in a first direction toward first end 212 of first housing section 204 or in an opposite, second direction toward second end 216 of first housing section 204. Cutting device 250 comprises blade holder 252 and cutting blade 254. Cutting blade 254 has tip 255. Cutting blade 254 is attached to blade holder 252. Blade holder 252 comprises body section 256, central section 258 and leg sections 260 and 262. Central section 258 has protrusion 264 thereon. Cutting blade 254 has opening 266 that is sized for receiving protrusion 264. Cutting blade 254 is frictionally inserted into the space between central section 258 and leg sections 260 and 262 such that protrusion 264 is inserted into opening 266 in cutting blade 254. Body portion 256 has slot 270 that has a predetermined depth and a pair of inlets, one of which being referred to by reference number 272, and the other not being shown (see FIG. 50). The purpose of slot 270 and the inlets is discussed in the ensuing description. When the cutting device 250 is moved in the direction of end 216 of first housing section 204, cutting blade 254 passes through passageway 218 and enters hollow interior 236 of second housing section 230.

In one embodiment, cutting blade 254 is fabricated from metal.

In an alternate embodiment, cutting blade 254 is encapsulated within a portion of blade holder 252 during the manufacturing process.

Referring to FIGS. 20, 25, 28 and 51-60, cutting device 250 has a portion thereof that is accessible through opening 224 in wall 220 of first housing section 204. Specifically, body portion 256 of cutting device 250 is accessible and viewable through opening 224. Apparatus 200 includes slide button 280 that is attached to body portion 256. Slide button 280 comprises top side 282 and bottom side 284. Top side 282 includes ribbed portions 286 which aid the user in sliding the slide button 280. Top side 282 also includes arrow 288 which indicates the directions in which slide button 280 can be slid. Arrow 288 is raised and can be formed during the manufacture of slide button 280. Slide button 280 includes protruding structure 290. Structure 290 is sized for insertion into slot 270 of body section 256. During assembly of apparatus 200, structure 290 is inserted through elongated opening 224 in wall 220 and then pressed into slot 270. Structure 290 comprises members 292 and 294 that are inserted into slot 270. Body portion 256 includes a pair of inlets located in slot 270, one of which being inlet 272 and the other not being shown. Structure 290 further comprises members 296 and 298. Member 296 includes hooked or flange portion 300 that grasps the edge of inlet 272 when structure 290 is inserted into slot 270. Similarly, member 298 includes hooked or flange portion 302 that grasps the edge of the corresponding inlet (not shown) in slot 270. Thus, once structure 290 is press-fitted into slot 270, slide button 280 becomes rigidly connected to body portion 256. After slide button 280 is connected to body portion 256, a portion of structure 290 remains positioned within the perimeter of elongated opening 224. In order to move cutting device 250 in the directions indicated by arrow 288 on slide button 280, a user may slide the slide button 280 in the desired direction. Bottom side 284 of slide button 280 has tab or projection 315 thereon. The purpose of tab 315 is discussed in the ensuing description.

Figure 23:
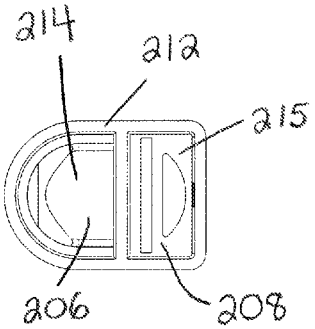
FIG. 23 is a view taken along line 23-23 of FIG. 22.
Figure 24:
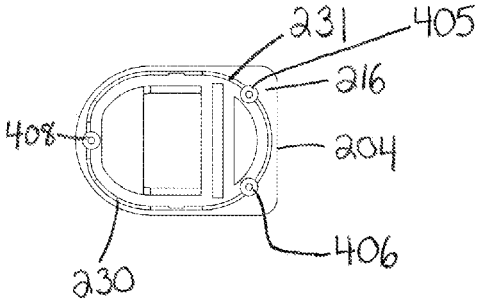
FIG. 24 is a view taken along line 24-24 of FIG. 22.
Figure 25:
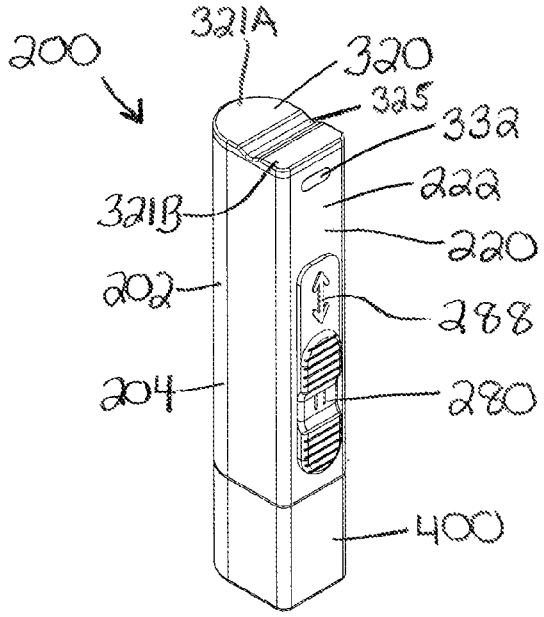
FIG. 25 is a perspective view, in elevation, of the apparatus of FIG. 19 completely assembled, the view showing the front and right sides of the apparatus.
Figure 26:
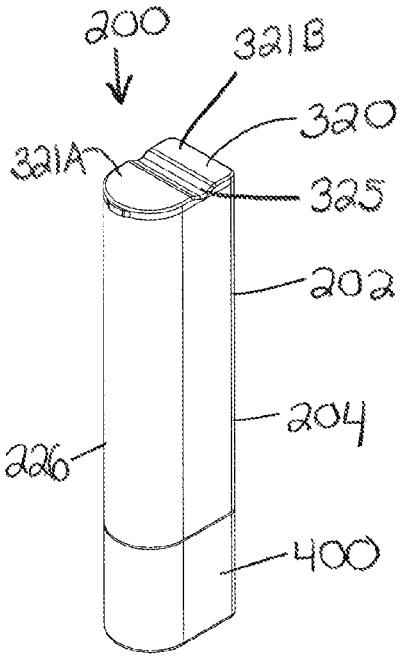
FIG. 26 is a perspective view, in elevation, of the apparatus of FIG. 19 completely assembled, the view showing the rear and right sides of the apparatus.
Figure 27:
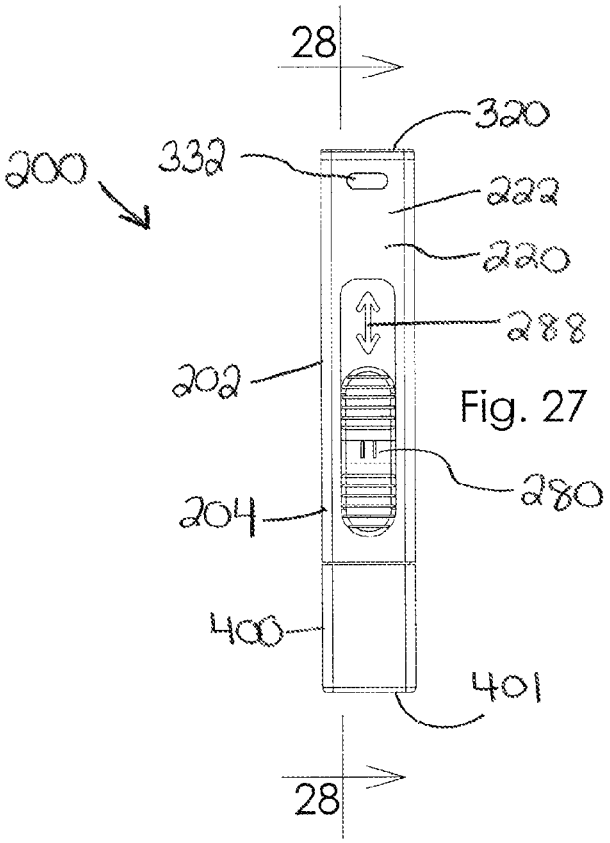
FIG. 27 is a front view, in elevation, of the apparatus of FIG. 19 completely assembled.
Figure 29:
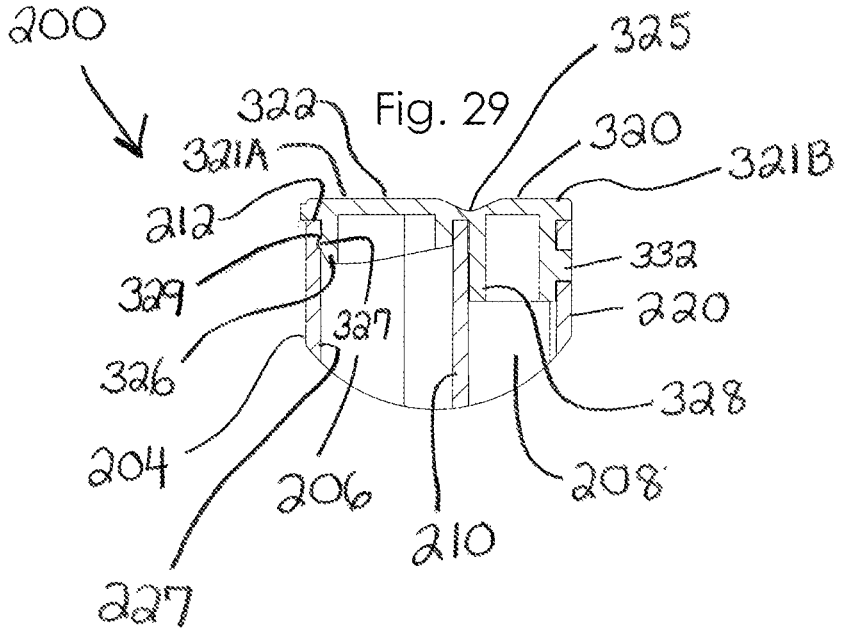
FIG. 29 is an enlarged view of a portion of the view shown in FIG. 28.
Figure 30:
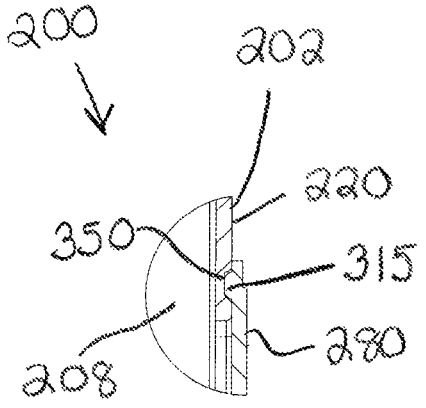
FIG. 30 is an enlarged view of a portion of the view shown in FIG. 28.

Referring to FIGS. 25-29, 34 and 61-66, apparatus 200 further comprises cap 320 that is removably attached to first end 212 of first housing section 204 to cover openings 214 and 215 (see FIG. 23). Cap 320 comprises cap portions 321A and 321B. Cap 320 includes top side 322 and bottom side 324. Cap portion 321A includes structure 326. Structure 326 has a shape and size that allows it to be frictionally inserted into opening 214 of first housing section 204. Structure 326 includes tab 327 that fits into a corresponding detent 329 on inner wall 227 of first housing section 204 (see FIGS. 29, 62, 63 and 64). Cap portion 321B comprises structure 328 that has a shape and size that allows it to be frictionally inserted into opening 215 of first housing section 204. Structure 328 has a rear side 330 which has projection 332 thereon. Projection 332 is sized to frictionally fit into opening 225 in first housing section 204 (see FIGS. 19 and 20). FIG. 29 shows cap 320 attached to first housing section 204. Cap portion 321A has lip 333 thereon. The purpose of lip 333 is discussed in the ensuing description. Cap 320 is fabricated from a material that enables cap portion 321A to bend or pivot at crease 325 with respect to cap portion 321B. One example of such a material is soft plastic. Structure 328 of cap portion 321B remains firmly positioned within opening 215 of compartment 208 at all times and projection 332 remains frictionally positioned within opening 225. Thus, cap portion 321B closes off compartment 208. In order to have access to compartment 206, the user uses his or her thumb to exert a slight upward force on lip 333 of cap portion 321A so that tab 327 pops of out corresponding detent 329 on wall 227. The user then pushes cap portion 321A upward. As a result, cap portion 321A pivots about crease 325 and opens so as to provide access to compartment 206. However, cap portion 321B always remains stationary and firmly positioned within opening 215 of compartment 208. Once cap portion 321A is open, the user can then insert a cigarette into or remove a cigarette from compartment 206. In order to close the cap, the user presses down on cap portion 321A so that structure 326 is reinserted into opening 214 and tab 327 slips into detent 329 in wall 227.

Referring to FIGS. 20, 28, 30, 53, 54, 56, 59 and 60, first housing section 204 includes detent 350 in wall 220 that is sized to receive tab 315 on bottom side 284 of slide button 280. When the user does not need to use the cutting device 250, the user positions slide button 280 so that tab 315 is positioned in detent 350 to prevent movement of the slide button 280 and cutting device 250. However, the shape of tab 315 and depth of detent 350 are such that tab 315 can be easily moved from detent 350 when the user simply slides the slide button 280 toward end 212 of first housing section 204.

Figure 36:
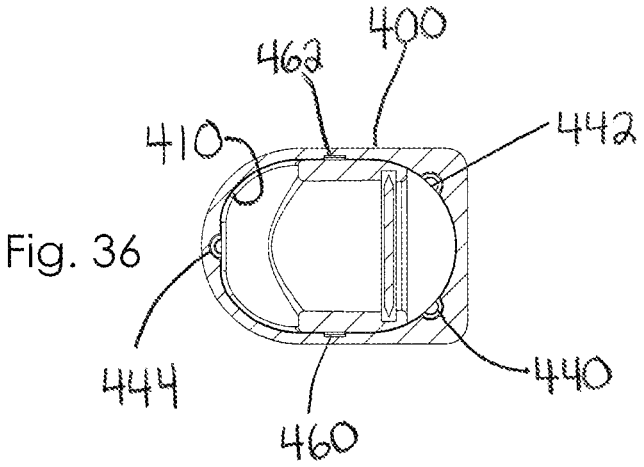
FIG. 36 is a cross-sectional view taken along line 36-36 of FIG. 33.
Figure 37:
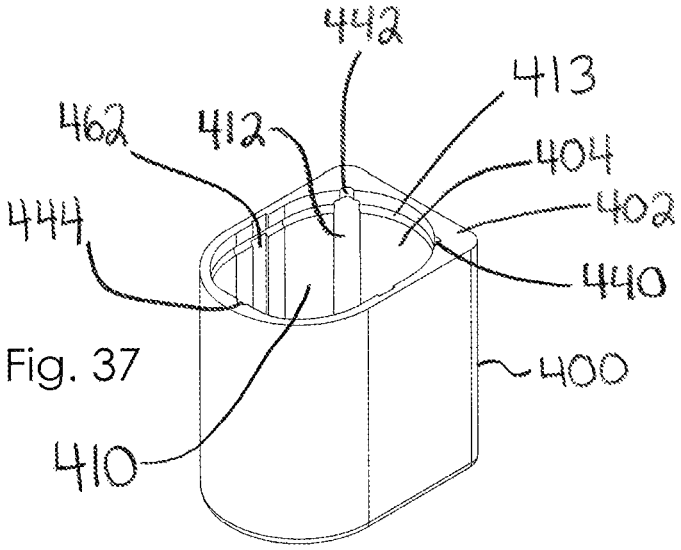
FIG. 37 is perspective view of a bottom cover shown in FIG. 19.
Figure 38:
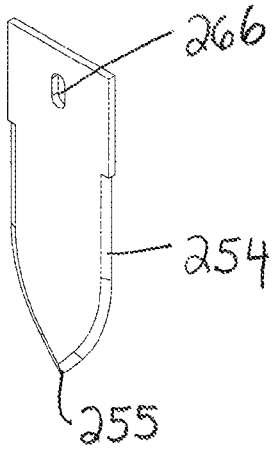
FIG. 38 is a perspective view of a blade shown in FIG. 19.
Figure 39:
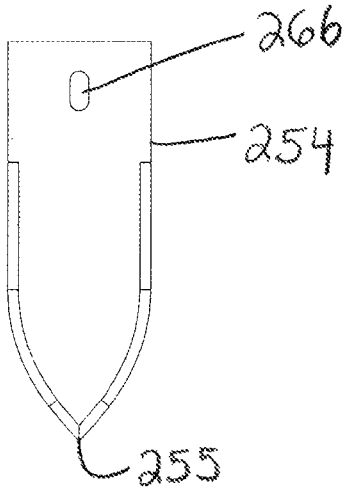
FIG. 39 is a front view, in elevation, of the blade, the rear view of the blade being essentially the same.
Figure 40:
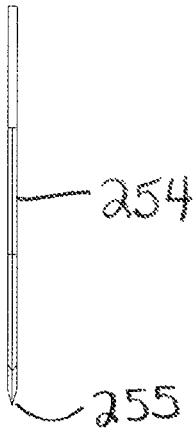
FIG. 40 is a side view, in elevation, of the blade.
Figure 41:
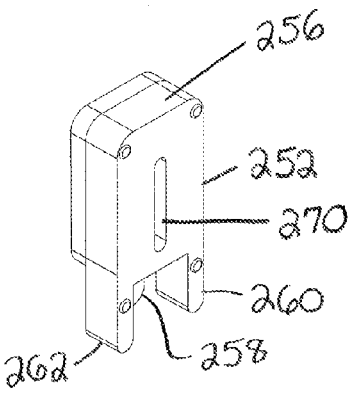
FIG. 41 is a perspective view of a blade holder shown in FIG. 19, the view showing the front side of the blade holder.
Figure 42:
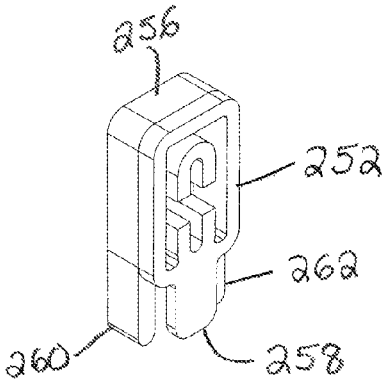
FIG. 42 is a perspective view of the blade holder, the view showing the rear side of the blade holder.
Figure 43:
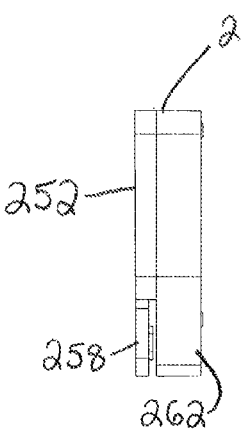
FIG. 43 is a side view, in elevation, of the blade holder, the view showing the right side of the blade holder.
Figure 44:
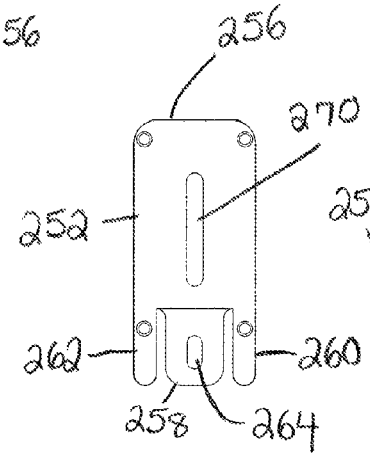
FIG. 44 is a front view, in elevation, of the blade holder.
Figure 45:
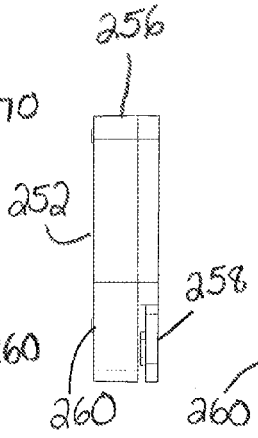
FIG. 45 is a side view, in elevation, of the blade holder, the view showing the left side of the blade holder.
Figure 46:
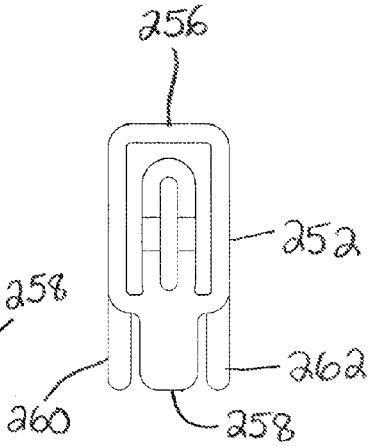
FIG. 46 is a rear view, in elevation, of the blade holder.
Figure 47:
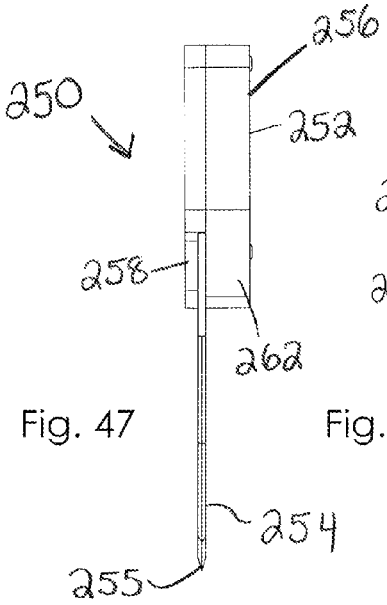
FIG. 47 is a right side view, in elevation, that illustrates the interconnection of the blade and the blade holder.
Figure 48:
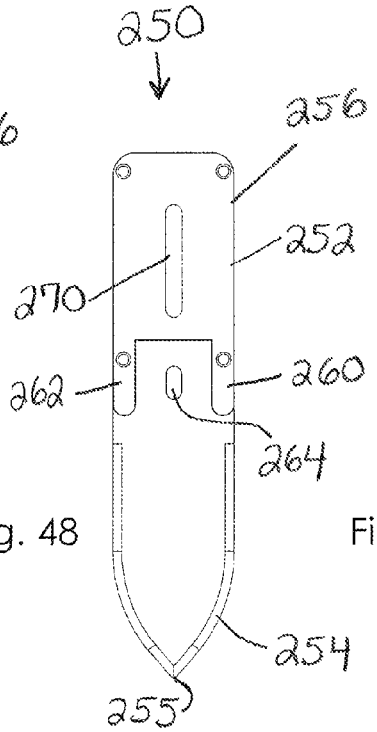
FIG. 48 is a front view, in elevation, that illustrates the interconnection of the blade and the blade holder.
Figure 49:
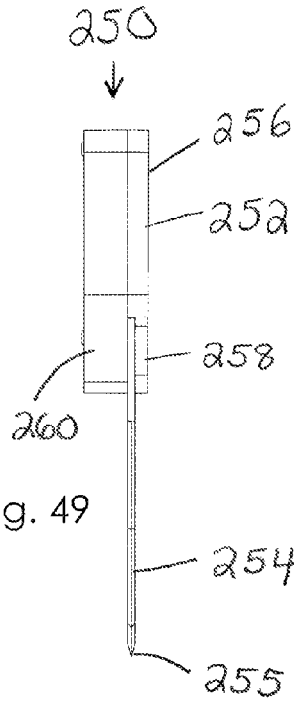
FIG. 49 is a left side view, in elevation, that illustrates the interconnection of the blade and the blade holder.

Referring to FIGS. 19, 20, 21, 22, 24, 25-28, 31, 32, 33 and 35-37, apparatus 200 further comprises cover 400 that is movably attached to second housing section 230. Cover 400 is movable between a first position which completely conceals second housing section 230 and a second position that exposes second housing section 230. Cover 400 has bottom end 401, top end 402 and hollow interior 404. Hollow interior 404 is sized for receiving second housing section 230. In accordance with the invention, cover 400 is slidably attached to second housing section 230. As shown in FIGS. 20 and 21, second housing section 230 has post members 405, 406 and 408. Post members 405 and 406 are on front side 230 and post member 408 is on rear side 234. Cover 400 has interior wall 410 that includes a plurality of rib portions, one of which being indicated by reference number 413. The purpose of rib portions 413 is discussed in the ensuing description. Interior wall 410 further includes a plurality of tracks, wherein each track corresponds to one of the post members 405, 406 and 408. One of the tracks, indicated by reference number is 412, is shown in FIG. 37. Each post member 405, 406 and 408 slides within a corresponding track so that cover 400 can be slidably attached to second housing section 230. Post members 405, 406 and 408 keep cover 400 attached to second housing section 230 when cover 400 is positioned to fully expose second housing section 230. Post members 405 and 406 have top portions 420 and 422, respectively. Similarly, post member 408 has top portion 424. Referring to FIG. 36, cover 400 has locking bumps 440, 442 and 444 that are on interior wall 410 in proximity to end 402. Each locking bump 440, 442 and 444 is located at the top end of a corresponding track. For example, as shown in FIG. 37, locking bump 442 is located at the top end of track 412. Locking bumps 440, 442 and 444 prevent cover 400 from falling off of second housing section 230. Specifically, when cover 400 is slid to the open position such that second housing section 230 is exposed, locking bump 440 contacts top portion 420 of post member 405, locking bump 442 contacts top portion 422 of post member 406, and locking bump 444 contacts top portion 424 of post member 408. The contact between the locking bumps and the top portions of the post members prevent cover 400 from falling off of second housing section 230. When cover 400 is closed and conceals second housing section 230, end 402 of cover 400 contacts end 216 of first housing section 204. Referring to FIGS. 20, 21, 22, 36 and 37, second housing section 230 includes raised portions 450 and 452 that are sized to fit into guide tracks 460 and 462, respectively, in interior wall 410 of cover 400. This configuration provides additional stability as cover 400 slides upon second housing section 230. As cover 400 is being slid into the closed position, rib portions 413 of interior wall 410 (see FIG. 37) frictionally contact and pass over rib 240 on second housing section 230 (see FIGS. 20, 21 and 22). When end 402 of cover 400 abuts end 216 of first housing section 204, rib portions 413 firmly abut rib 240 and are located between rib 240 and end 216 of first housing section 204. Such a configuration allows cover 400 to firmly snap close.

When a user desires to cut off a used portion of a cigarette, the user first slides cover 400 away from end 216 of first housing section 204 to expose second housing section 230. The user then inserts the used portion of a cigarette into opening 238 of second housing section 230. The user continues to move the cigarette so that the used portion of the cigarette passes through hollow interior 236 and protrudes from opening 239. The user may adjust the position of the cigarette so that none of the unused portion of the cigarette is accidently cut off. When the user is satisfied that the cigarette is correctly positioned, the user then uses his finger to slide the slide button 280 toward second housing section 230. This causes the cutting device 250 within compartment 208 to move toward second housing section 230 and cutting blade 254 to pass through passageway 218 and into hollow interior 236 so as to cut off the used portion of the cigarette. When the used portion of the cigarette is cut off, the user opens cap portion 321A and inserts the remaining portion of the cigarette into compartment 206. The user then closes cap portion 321A. If the user desires, he or she may then insert apparatus 200 in a pack of cigarettes. Once cap portion 321A and cover 400 are snapped closed, the unused portion of the cigarette in compartment 206 cannot taint the other cigarettes in the pack of cigarettes.

Apparatus 200 may be fabricated from a variety of suitable materials. For example, with the exception of cutting blade 254, the components of apparatus 200 may be fabricated from plastic. If the components of apparatus 200 are to be fabricated from plastic, then it is preferable that injection molding be used. In an alternate embodiment, cutting blade 254 is fabricated from plastic. The size of apparatus 200 may be varied so it may be used in a variety of applications. For example, apparatus 200 may be increased in size so that it could be used with cigars.

It is also to be understood that the invention is not limited to the illustrations described and shown herein, which are deemed to be merely illustrative of the best modes of carrying out the invention, and which are susceptible of modification of form, size, arrangement or position of parts, and details of operation. Rather, the invention is intended to encompass all such modifications which are within the spirit and scope as defined by the claims.

What is claimed is:

1. An apparatus for cutting away a used portion of a cigarette and storing the remaining portion of the cigarette, comprising:

a housing comprising:

a first housing section having a first compartment for storing a cigarette and a second compartment that is separate from the first compartment, the first housing section having a first end that has an opening to allow a cigarette to be inserted into or removed from the first compartment, the first housing section further comprising a second end that is opposite the first end, wherein the second end closes off the first compartment and has a passageway in communication with the second compartment, the first housing section comprising an exterior wall having an opening that is located between the first and second ends of the first housing section and which is in communication with the second compartment;

a second housing section joined to the second end of the first housing section, the second housing section comprising a front portion having an opening, a rear portion having an opening, and a hollow interior located between the openings of the front and rear portions, wherein the openings provide access to the hollow interior, wherein the openings and hollow interior are sized to receive a cigarette;

a cutting device movably positioned within the second compartment, wherein the cutting device can move in a first direction toward the first end of the first housing section or in an opposite, second direction toward the second end of the housing, the cutting device comprising a blade that passes through the passageway of the second end and enters the hollow interior of the second housing section when the cutting device is moved in the second direction;

a button positioned on the first housing section and having a portion that extends through the opening in the exterior wall in the first housing and is connected to the cutting device, wherein the button allows a user to move the cutting device in the first and second directions; and wherein when a user desires to cut off a used portion of a cigarette, the user inserts the used portion of the cigarette through the opening of the front portion of the second housing section so that the used portion of the cigarette enters the hollow interior and protrudes from the opening of the rear portion of the second housing section, and then moves the button so that the cutting blade enters the hollow interior and cuts off the used portion of the cigarette, and wherein the user then stores the remaining portion of the cigarette in the first compartment.

2. The apparatus according to claim 1 further comprising a cap attached to the first end of the first housing section, the cap having a crease and a movable portion that pivots about the crease, the movable portion pivoting between a closed position to close the opening to the first compartment and an opened position that provides access to the first compartment.

3. The apparatus according to claim 1 further comprising a cover having a hollow interior sized to receive the entire second housing section, the cover being slidably attached to the second housing section, wherein a user can slide the cover between a first position to completely conceal the second housing section and a second position to expose the second housing section.

4. The apparatus according to claim 3 further comprising means for preventing the cover from sliding off the second housing section.

5. The apparatus according to claim 4 further comprising means for guiding the cover as it moves upon the second housing section.

6. The apparatus according to claim 1 wherein the first and second compartments are in juxtaposition.

7. The apparatus according to claim 1 further comprising means for connecting the slide button to the cutting device.

8. The apparatus according to claim 1 wherein the cutting device comprises a blade holder and a blade attached to the blade holder.

9. The apparatus according to claim 1 wherein the opening in the exterior wall of the first housing section is a longitudinally extending opening.

10. The apparatus according to claim 9 wherein the cutting device has a portion thereof viewable and accessible through the longitudinally extending opening in the exterior wall of the first housing section.

11. The apparatus according to claim 9 wherein the button is a slide button.

12. The apparatus according to claim 11 wherein the slide button is located on the exterior wall and positioned over the longitudinally extending opening.

13. The apparatus according to claim 12 wherein the slide button comprises a rear side and a protrusion on the rear side, and wherein the exterior wall has a detent sized for receiving the protrusion so that the slide button does not move on its own when the protrusion is located within the detent.

14. The apparatus according to claim 13 wherein the detent is located in proximity to the longitudinally extending opening.

* * * * *